US006665900B2

(12) United States Patent
Wichmann et al.

(10) Patent No.: US 6,665,900 B2
(45) Date of Patent: Dec. 23, 2003

(54) POOL CLEANER

(75) Inventors: Jeffrey A. Wichmann, Cardiff, CA (US); Gerhardus J. Stoltz, Temecula, CA (US); Arunabh Lath, La Mesa, CA (US)

(73) Assignee: Polaris Pool Systems, Vista, CA (US)

( * ) Notice: Subject to any disclaimer, the term of this patent is extended or adjusted under 35 U.S.C. 154(b) by 0 days.

(21) Appl. No.: 10/397,939

(22) Filed: Mar. 25, 2003

(65) Prior Publication Data

US 2003/0182742 A1 Oct. 2, 2003

Related U.S. Application Data

(60) Provisional application No. 60/368,668, filed on Mar. 29, 2002.

(51) Int. Cl.[7] ..... E04H 4/16
(52) U.S. Cl. ..... 15/1.7
(58) Field of Search ..... 15/1.7

(56) References Cited

U.S. PATENT DOCUMENTS

| | | | | |
|---|---|---|---|---|
| 3,822,754 | A | | 7/1974 | Henkin et al. |
| 3,936,899 | A | | 2/1976 | Henkin et al. |
| 3,972,339 | A | | 8/1976 | Henkin et al. |
| 4,023,227 | A | | 5/1977 | Chauvier |
| 4,133,068 | A | | 1/1979 | Hofmann |
| 4,208,752 | A | | 6/1980 | Hofmann |
| 4,558,479 | A | | 12/1985 | Greskovics et al. |
| 4,575,423 | A | | 3/1986 | Alanis et al. |
| 4,589,986 | A | * | 5/1986 | Greskovics et al. |
| 4,618,420 | A | | 10/1986 | Alanis |
| 4,643,217 | A | | 2/1987 | Frentzel |
| 4,729,406 | A | | 3/1988 | Frentzel |
| 4,761,848 | A | | 8/1988 | Hofmann |
| 4,769,867 | A | | 9/1988 | Stoltz |
| 5,105,496 | A | | 4/1992 | Gray, Jr. et al. |
| 5,265,297 | A | | 11/1993 | Gould et al. |
| 5,342,513 | A | * | 8/1994 | Wall et al. |
| 5,603,135 | A | | 2/1997 | Jones et al. |
| 5,634,229 | A | | 6/1997 | Stoltz |
| 5,863,425 | A | | 1/1999 | Herlehy et al. |
| 5,893,188 | A | | 4/1999 | Campbell et al. |
| 5,933,899 | A | | 8/1999 | Campbell et al. |
| 6,003,184 | A | | 12/1999 | Campbell et al. |
| 6,094,764 | A | | 8/2000 | Veloskey et al. |
| 6,112,354 | A | | 9/2000 | Stoltz et al. |

* cited by examiner

*Primary Examiner*—Randall E. Chin
(74) *Attorney, Agent, or Firm*—Kelly Bauersfeld Lowry & Kelley, LLP

(57) ABSTRACT

An improved pool cleaner is provided of the type for random travel over submerged floor and side wall surfaces of a swimming pool or the like to dislodge and collect debris. The pool cleaner includes a hydraulically contoured external housing having a stabilizer float integrated with a carrying handle at an elevated rearward location. The pool cleaner additionally incorporates modular components including a simplified mast unit and related water distribution manifold for delivery of water under pressure to a water turbine drive unit for rotatably driving cleaner wheels to travel over submerged pool surfaces, with a portion of the pressurized water inducing a vacuum action for collecting debris within a porous filter bag. The modular components are mounted on an internal frame which is quickly and easily accessible for service or maintenance by removal of the external housing.

70 Claims, 14 Drawing Sheets

FIG. 1
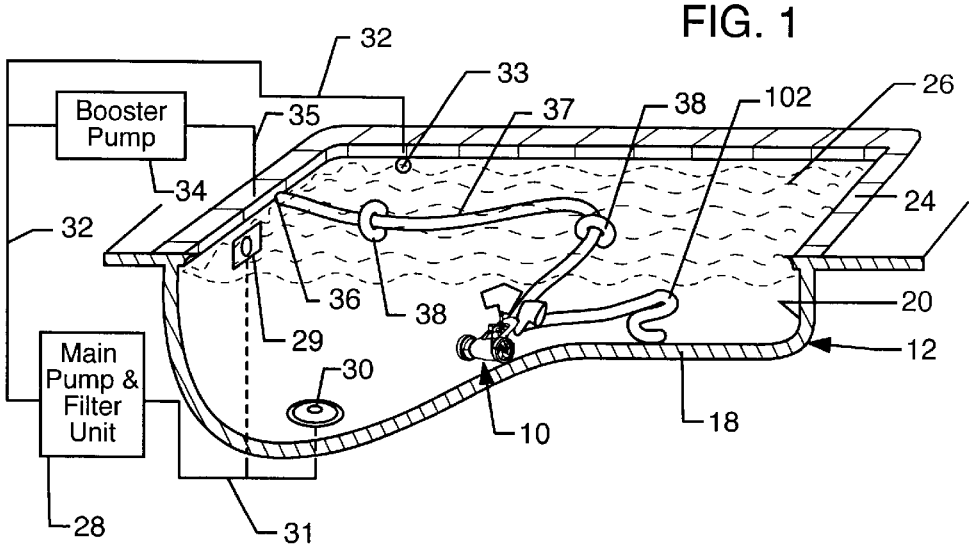
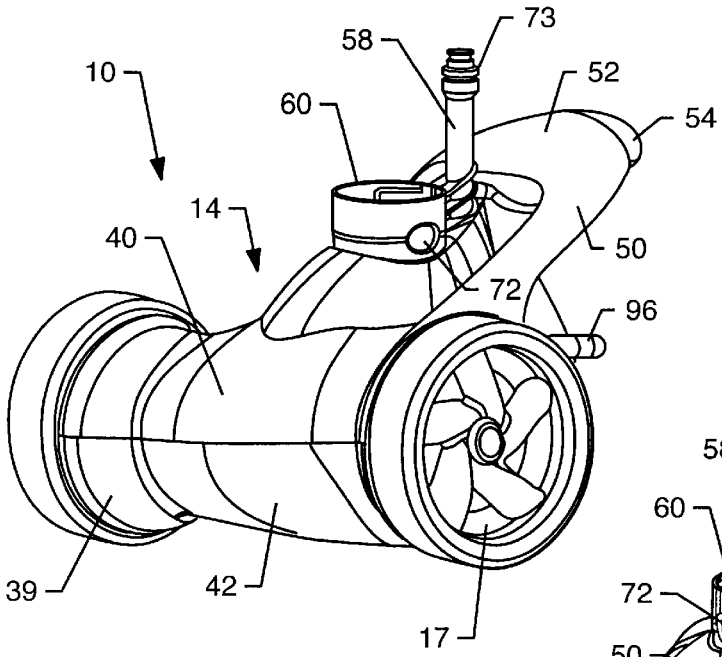
FIG. 2
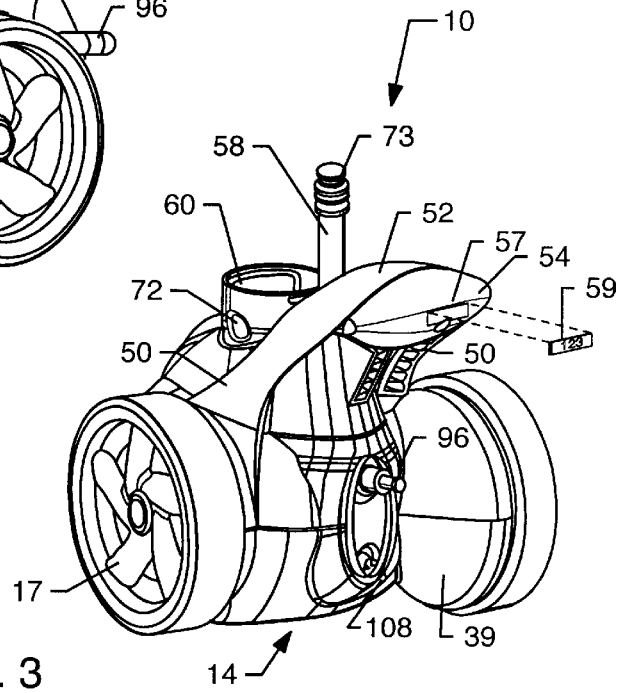
FIG. 3

POOL CLEANER

This application claims the benefit of copending U.S. Provisional Application No. 60/368,668, filed Mar. 29, 2002.

BACKGROUND OF THE INVENTION

This invention relates generally to pool cleaner devices for dislodging and/or collecting debris within swimming pools and the like. More particularly, this invention relates to an improved pool cleaner of the type designed for submerged and generally random travel along the floor and side wall surfaces of a swimming pool to dislodge and collect fine sediment and other debris accumulated thereon.

Pool cleaner devices are generally known in the art for use in maintaining residential and commercial swimming pools in a clean and attractive condition. In this regard, swimming pools conventionally include a water filtration system including a pump for drawing or suctioning water from the pool for circulation through a filter canister having filter media therein to remove and collect water-entrained debris such as leaves and twigs as well as fine particulate including sand and silt. From the filter canister, the water is recirculated to the pool via one or more return lines. Such filtration system is normally operated for several hours on a daily basis and serves, in combination with traditional chemical treatments such as chlorination or the like, to maintain the pool water in a clean and clear sanitary state. However, the water filtration system is ineffective to filter out debris which settles onto submerged floor and side wall surfaces of the swimming pool. In the past, settled debris has typically been removed by coupling a vacuum hose to the intake or suction side of the pool water filtration system, such as by connecting the vacuum hose to a skimmer well located near the water surface at one side of the pool, and then manually moving a vacuum head coupled to the hose over the submerged pool surfaces to vacuum settled debris directly to the filter canister where it is collected and separated from the pool water. However, manual vacuuming of a swimming pool is a labor intensive task and is thus not typically performed by the pool owner or pool cleaning service personnel on a daily basis.

Automatic pool cleaner devices have been developed over the years for cleaning submerged pool surfaces, thereby substantially eliminating the need for labor intensive manual vacuuming. Such automatic pool cleaners typically comprise a relatively compact cleaner housing or head coupled to the pool water filtration system by a hose and including water-powered means for causing the cleaner to travel about within a swimming pool to dislodge and collect settled debris. In one form, the pool cleaner is connected to the return or pressure side of the filtration system for receiving positive pressure water which powers a turbine for rotatably driving cleaner wheels, and also functions to induce a vacuum by venturi action to draw settled debris into a filter bag. See, for example, U.S. Pat. Nos. 3,882,574; 4,558,479; 4,589,986; 4,734,954; and 5,863,425. In another form, the pool cleaner is coupled to the suction side of the filtration system, whereby water is drawn through the pool cleaner to operate a drive mechanism for transporting the cleaner within the pool while vacuuming settled debris to the filter canister of the pool filtration system. See, for example, U.S. Pat. Nos. 3,803,658; 4,023,227; 4,133,068; 4,208,752; 4,643,217; 4,679,867; 4,729,406; 4,761,848; 5,105,496; 5,265,297; 5,634,229; 6,094,764; and 6,112,354.

The present invention relates to improvements in automatic pool cleaner devices, particularly with respect to providing a simplified pool cleaner construction wherein modular hydraulic and mechanical components are arranged for quick and easy assembly, and for subsequent facilitated access for service and replacement as needed.

SUMMARY OF THE INVENTION

In accordance with the invention, an improved automatic pool cleaner is provided for submerged and generally random travel over the floor and submerged side wall surfaces of a swimming pool or the like to collect debris accumulated thereon. The pool cleaner comprises a hydraulically contoured external housing or shell encasing an internal frame upon which modular cleaner components are installed.

In the preferred form, the pool cleaner is adapted for connection via a flexible hose to a supply of water under pressure, such as by connection to the return or pressure side of a pool water filtration system. A cleaner mast unit is mounted on the internal frame and includes a supply mast having an upper end exposed through the housing shell for connection to the supply hose. The supply mast delivers the water under pressure to a water distribution manifold, which is also mounted onto the internal frame as a modular component. The water distribution manifold couples the pressurized water flow to a turbine drive unit including a water-driven turbine and appropriate reduction gears for generating a rotary drive output used for rotatably driving a plurality of cleaner wheels. The water distribution manifold additionally provides water under pressure to a plurality of upwardly directed jet nozzles mounted within a suction mast, formed as part of the cleaner mast unit, for inducing an upward vacuum-type action for drawing debris from beneath the pool cleaner and through the suction mast into a porous filter bag mounted at an upper end thereof. The water distribution manifold additionally provides water under pressure to a rearwardly directed thrust jet, and also to a rearwardly directed sweep hose fitting adapted for connection to a flexible sweep hose trailing the pool cleaner. The water distribution manifold and sweep hose fitting desirably include cooperative means for adjustably regulating water flow rearwardly through the sweep hose.

The turbine drive unit includes a rotatably driven output shaft having a pair of output drive gears carried respectively at opposite ends thereof. Each of these output drive gears is coupled at the associated sides of the internal frame, but within the housing shell, to a sprocket chain which is coupled in turn with a driven gear at the inboard side of each cleaner wheel for positively driven said cleaner wheels. In the preferred form, each cleaner wheel has a relatively large diameter bearing hub which is rotatably supported at an outboard end of a stub axle, which in turn has an inboard end secured by an anchor block seated within an elongated slot formed on the internal frame of the pool cleaner. The driven gear associated with each cleaner wheel is rotatably driven by the sprocket chain, and engages and drives the relatively large diameter bearing hub by means of a splined coupling for rotatably driving the cleaner wheel.

The external housing shell comprises upper and lower housing shells mounted onto the internal frame to encase and substantially enclose the modular components mounted on said internal frame. Each of the upper and lower housing shells is quickly and easily removable from the internal frame for access to the internal frame and the modular components mounted thereon in the event that service or replacement is required. In addition, the upper housing shell includes a convenient carrying handle with an integrated stabilizer float at a location spaced above and rearwardly of a center of gravity for the pool cleaner, for maintaining the pool cleaner in an upright orientation during normal cleaning operation within a swimming pool.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a somewhat schematic perspective view illustrating an improved pool cleaner embodying the novel features of the invention and shown in operation traveling generally along a floor of a swimming pool;

FIG. 2 is an enlarged front perspective view of the pool cleaner of FIG. 1;

FIG. 3 is a partially exploded rear perspective view of the pool cleaner of FIG. 1;

DETAILED DESCRIPTION OF THE PREFERRED EMBODIMENT

Figure 4:
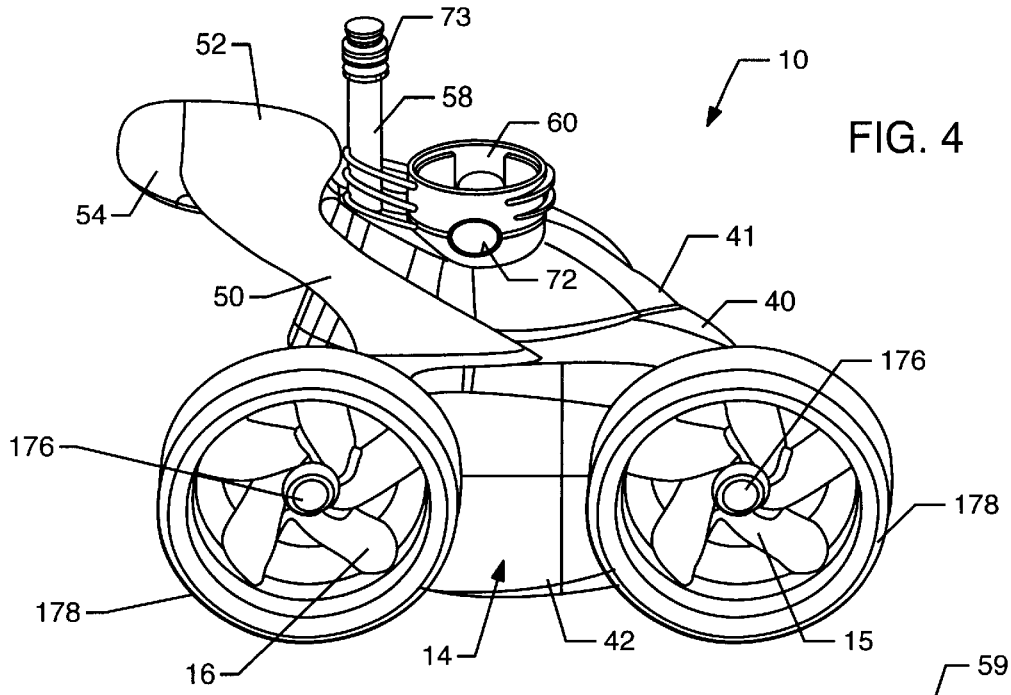
FIG. 4 is a further enlarged perspective view showing the right and top sides of the pool cleaner of FIG. 1.
Figure 5:
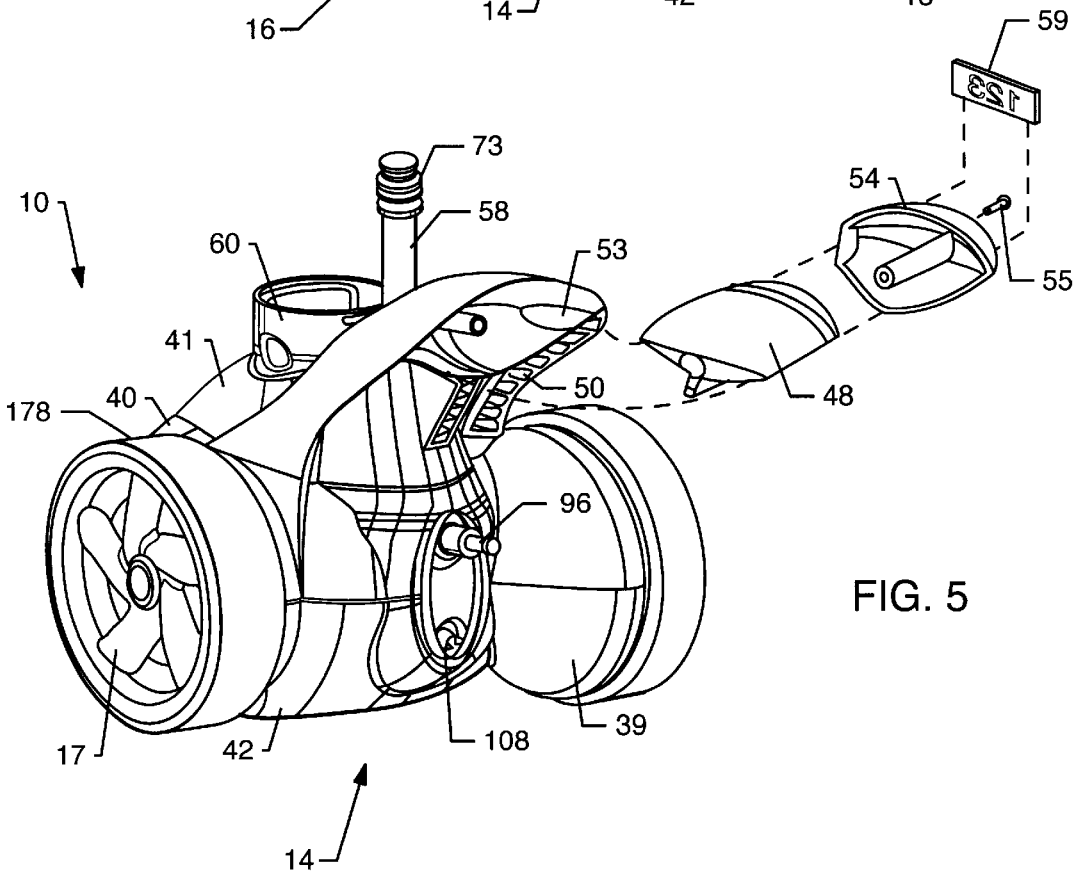
FIG. 5 is an exploded rear perspective view depicting assembly of a stabilizer float mounted within an upper portion of a housing for the pool cleaner.
Figure 6:
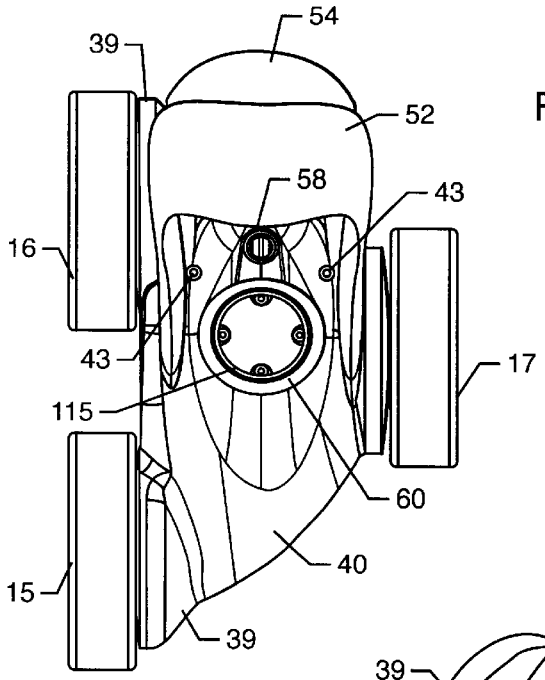
FIG. 6 is a top plan view of the pool cleaner.

As shown in the exemplary drawings, an improved automatic swimming pool cleaner referred to generally by the reference numeral 10 is provided for dislodging and/or collecting debris and sediment from within a swimming pool 12 or the like, as viewed in FIG. 1. The pool cleaner comprises an hydraulically contoured external housing 14 (FIGS. 2–10) encasing a hydraulically operated drive system (FIGS. 7–8 and 11–22) for rotatably driving a plurality of wheels 15, 16 and 17 which support the pool cleaner 10 for travel over the floor 18 and side walls 20 (FIG. 1) of the swimming pool. In addition, the pool cleaner 10 includes a hydraulic vacuum system (FIGS. 7–10, and 14–15) for drawing debris and sediment into a porous collection or filter bag 22 (FIG. 1). In accordance with the invention, the improved pool cleaner 10 has a modular construction with the hydraulic drive and vacuum system components mounted onto an internal frame 23 (FIGS. 7–8, 10–11, 14, and 18–19) for easy access to the modular components by removal of the external housing 14 in the event that component service or replacement is required.

The automatic swimming pool cleaner 10 of the present invention constitutes an improvement upon swimming pool cleaners of the general type described in U.S. Pat. Nos. 3,822,754; 4,558,479; 4,589,986; 4,734,954; and 5,863,425, which are incorporated by reference herein. Such pool cleaners are designed for generally random travel over the floor 18 and submerged side walls 20 of the swimming pool 12 having virtually any conventional construction and configuration. More particularly, as depicted in FIG. 1 by way of example, such swimming pools 12 commonly include the pool floor 18 which may be generally horizontal or of sloping contour to define comparatively shallower and deeper regions of the pool. The pool floor 18 blends generally smoothly with the side walls 20 which extend upwardly to appropriate decking 24 or the like above the surface of water 26 filling the pool.

A swimming pool 12 of this general type is typically provided with a filtration system 28 depicted schematically in FIG. 1 for filtering particulate and other foreign matter from the pool water 26 to maintain the pool water in a relatively clear and sanitary state. This filtration system is normally installed at a convenient location near the swimming pool and includes a circulation pump for drawing water from the pool through one or more suction ports such as a skimmer well 29 located generally at the water surface at one side of the pool and/or a floor drain 30 located in the pool floor 18. The pool water is drawn through these suction ports 29, 30 for passage through appropriate suction conduits 31 and to a filter canister which separates water-entrained particulate from the pool water. The filtered pool water is coupled from the filter canister through one or more return conduits 32 for recirculation to the pool via on or more return ports 33 typically positioned slightly below the surface of the pool water 26.

The pool cleaner 10 of the present invention is hydraulically operated to travel back and forth in a generally random pattern over the pool floor 18 and to climb the side walls 20 for collecting debris and sediment and the like within the filter bag 22, wherein this particulate matter may have settled onto these submerged pool floor and side wall surfaces. In addition, the pool cleaner 10 includes means for disturbing and dislodging settled debris and sediment for suspension thereof within the pool water 26 for ultimate flow into and filtration within the main filtration system 28. Accordingly, the pool cleaner 10 collects debris such as leaves and twigs and the like within the filter bag 22, wherein such debris is often not drawn into the circulation system for capture by the filtration system 28, and further functions further to maintain fine particulate in suspension with the pool water 26 to improve the overall effectiveness of the main filtration system 28. In addition, the pool cleaner 10 tends to circulate and distribute pool chemicals such as chlorine substantially uniformly throughout the pool water, wherein such chemicals are heavier than water and otherwise tend to settle with higher concentrations at or near the bottom of the pool. Advantageously, the pool cleaner operates automatically and substantially unattended, requiring only occasional emptying of the debris collection bag 22.

The hydraulic drive and vacuum systems of the pool cleaner 10 are powered by a supply of water under pressure obtained conveniently and directly from the main filtration system 28 of the swimming pool 12. In this regard, a cleaner supply conduit 35 is shown in FIG. 1 coupled to the pressure discharge side of the main filtration system 28 for receiving a flow of pressurized water. As is known in the art, a booster pump 34 may be installed in-line with the cleaner supply conduit 35. The cleaner supply conduit 35 is connected to a cleaner supply fitting 36 mounted at a convenient location in a pool side wall 20. An elongated flexible hose 37 formed from a lightweight plastic material has an upstream end connected to the supply fitting 36 and a downstream end suitably coupled to the pool cleaner 10. The length of this flexible hose 37 is chosen to permit travel of the pool cleaner over substantially the entire submerged surface areas of the floor 18 and side walls 20, and may include one or more swivel joints 38 along the length thereof to relieve and accommodate hose twisting without kinking that could otherwise interfere with the desired cleaner operation and movement.

FIGS. 2–7 show the assembled pool cleaner 10 to include the hydraulically contoured external housing 14. Two of the cleaner wheels 15 and 16 respectively comprise front and rear wheels mounted in a spaced front-to-rear orientation at one side of the housing 14. The third cleaner wheel 17 is shown mounted at the opposite side of the housing in a position with its rotational axis offset rearwardly with respect to the front wheel 15, and forwardly with respect to the rear wheel 16. The pool cleaner 10 thus has a generally triangular footprint defined by the three cleaner wheels 15, 16 and 17. In addition, with this arrangement, the housing 14 may include a frontal nose configuration extending generally angularly or obliquely in a transverse and rearward direction from the front wheel 15 toward the opposite side wheel 17. The housing 14 may also include a rearward configuration extending generally angularly in a transverse and forward direction from the rear wheel 16 toward the opposite side wheel 17. As shown, the housing 14 may conveniently include contoured cowlings 39 at the inboard sides of the cleaner wheels to overlie and substantially conceal drive train components to be described in further detail herein. If desired, a common traction tread (not shown) can be carried about the front and rear wheels 15, 16 at one side of the cleaner housing 14.

The external housing 14 is formed from upper and lower housing shells 40 and 42 each formed from a lightweight molded plastic or the like and adapted for quick and easy mounting onto and disassembly from the internal frame 23. More particularly, the upper housing shell 40 is removably mounted onto the internal frame 23 by means of screws 43 (FIGS. 6 and 7) or the like, and defines the upper half of the external housing 14 including a trio of semicircular and downwardly open cut-outs 44 (FIGS. 7 and 19) to accommodate wheel mount and rotary bearing structures to be described. Similarly, the lower housing shell 42 is removably mounted onto the internal frame 23 by means of screws 45 (FIGS. 9 and 10), and defines the lower half of the external housing 14 also including a trio of semicircular and upwardly open cut-outs 46 (FIGS. 10 and 19) to accommodate the wheel mount and rotary bearing structures to be described. When mounted onto the internal frame 23, the upper and lower housing shells 40 and 42 fit matingly together for substantially enclosing and encasing the internal hydraulic drive and vacuum system components of the improved pool cleaner. However, these upper and lower housing shells 40 and 42 are separately or individually removable from the internal frame 23 for convenient access to internal cleaner components, when and if required.

According to one aspect of the invention, the upper housing shell 40 carries a stabilizer float 48 (FIG. 5) at a relatively high and rearward position on the pool cleaner 10. More particularly, the upper housing shell 40 includes a pair of generally parallel struts 50 extending upwardly and rearwardly from opposite sides of the cleaner housing. The upper ends of these struts 50 terminate at a location substantially above and behind a center of gravity for the assembled pool cleaner. These strut upper ends are integrally joined with a transversely extending handle 52 which, in addition to providing a convenient hand grip for manually handling and carrying the pool cleaner, defines a rearwardly open pocket 53 (FIG. 5) for receiving the float 48 formed from a buoyant material such as a closed cell foam or the like. The float 48 is seated within the handle pocket 53, and a shell-shaped float cap 54 is mounted thereover by means of a screw 55 or the like to encase the float 48 within the handle pocket 53. In use, when the pool cleaner 10 is placed into the pool water 26, the stabilizer float 48 orients the pool cleaner so that it will land upon the pool floor 18 in an upright orientation with the cleaner wheels engaging the pool floor. The float additionally assists in turning the cleaner around when climbing and subsequently descending vertical pool walls, resulting in a fast and effective random cleaning pattern.

In accordance with one aspect of the invention, the rear side of the float cap 54 incorporates a rearwardly presented recess 57 (FIG. 3) circumscribing the hole therein for receiving the screw 55. This recess 57 is conveniently formed in a generally rectangular shape, corresponding generally to the proportional width and height of a traditional vehicle license plate. A nameplate 59 (FIGS. 3 and 5) is provided for nested mounting as by an adhesive and/or snap-fit connection or the like into this recess 57, in a position visible from the rear of the pool cleaner. In the preferred form, the nameplate 59 includes alphabetic and/or numerical indicia to present the appearance of a vehicle license plate, wherein this indicia may be customized as desired to suit the individual owner of the pool cleaner. For example, the nameplate 59 may carry or bear numbers, letters, or other symbols, or combinations thereof. The structure of the nameplate 59 may comprise a multi-color physical plate having the appearance of a small automobile license plate or the like bearing indicia in two or three dimensional form, or it may comprise an applique or otherwise be formed by molding or similar forming directly on or in the float cap 54 or other rearwardly facing structure on the pool cleaner.

Figure 7:
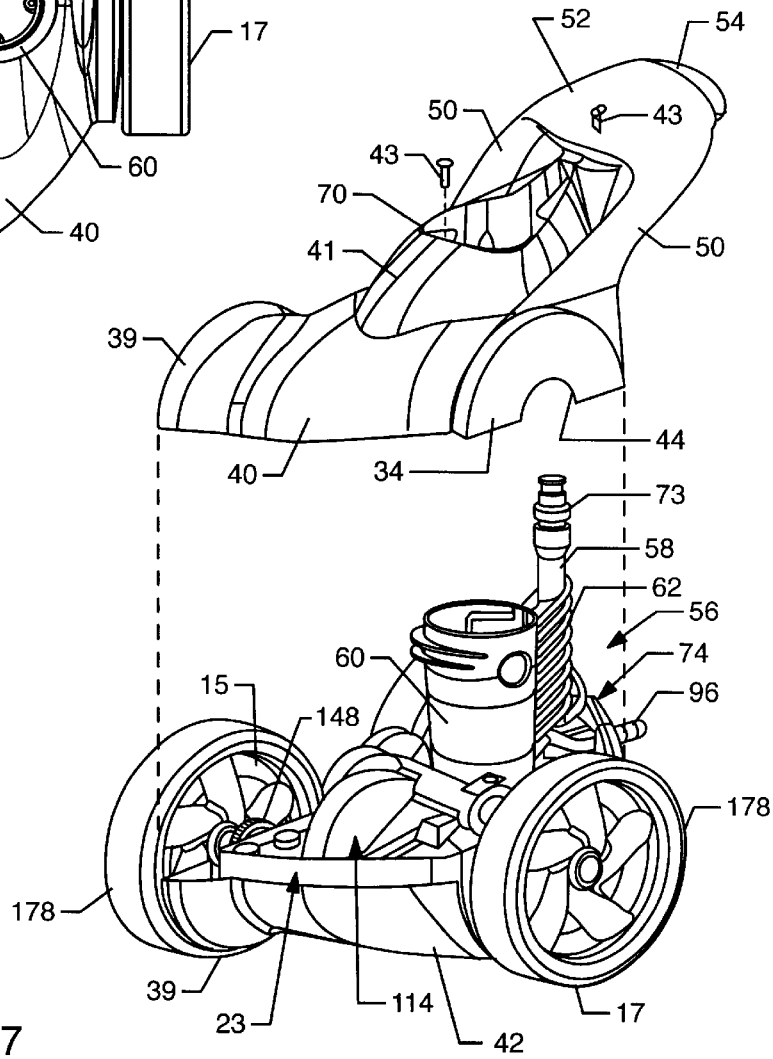
FIG. 7 is an exploded top perspective view of the pool cleaner showing an upper housing shell, forming a portion of the pool cleaner housing, in exploded relation to reveal an internal frame having drive components mounted thereon.
Figure 8:
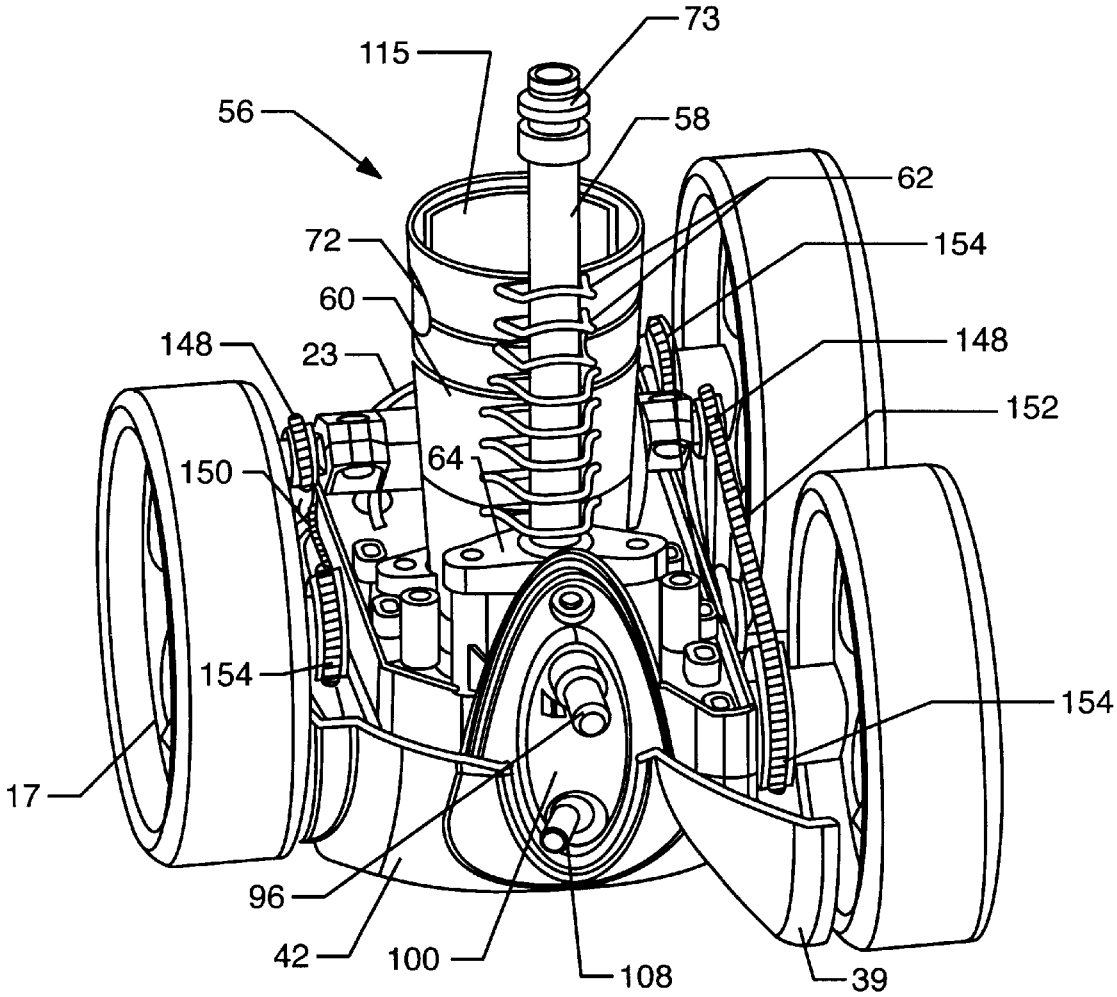
FIG. 8 is an enlarged rear perspective view illustrating the pool cleaner with the upper housing shell removed.
Figure 9:
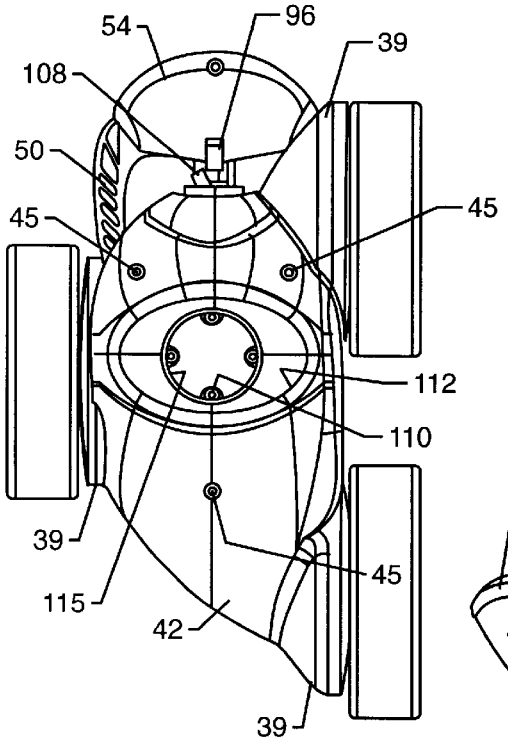
FIG. 9 is a bottom plan view of the pool cleaner.
Figure 10:
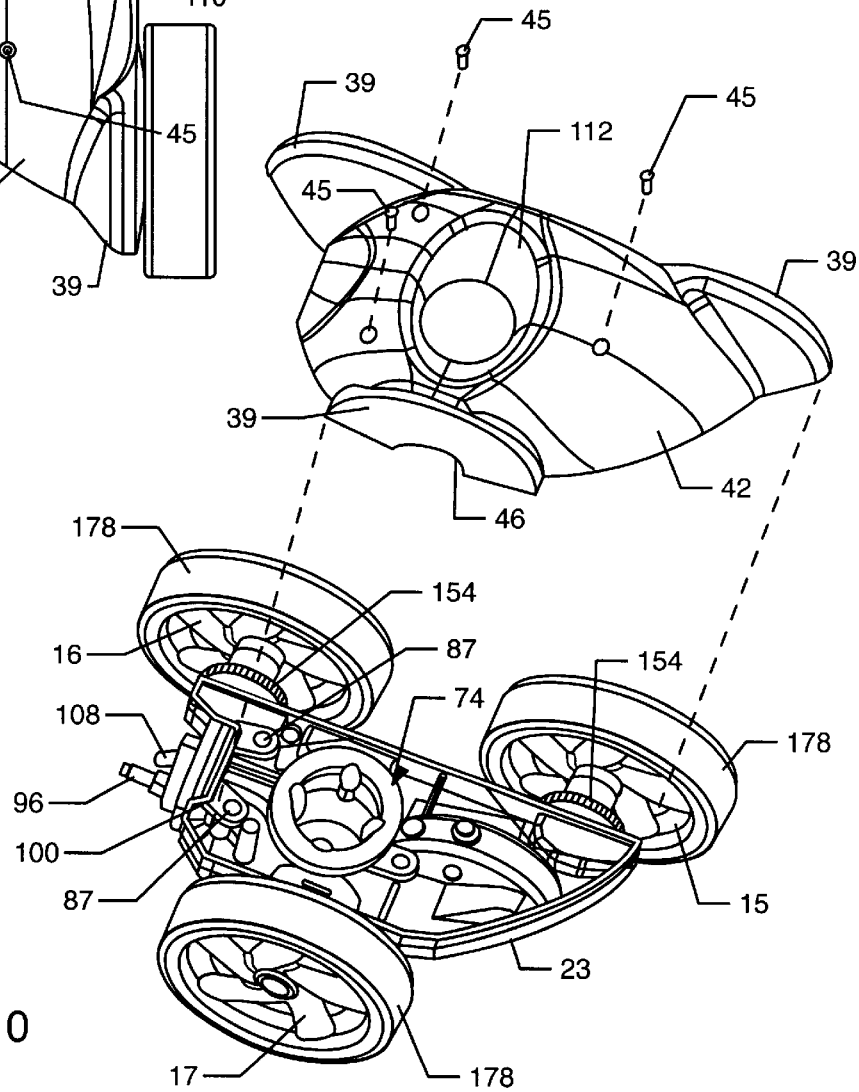
FIG. 10 is an exploded bottom perspective view of the pool cleaner showing a lower housing shell, also forming a portion of the pool cleaner housing, in exploded relation to reveal the internal frame.

FIG. 7 illustrates removal of the upper housing shell 40 from the pool cleaner internal frame 23. Such removal of the upper housing shell 40 exposes a cleaner mast unit 56 for access. In this regard, the mast unit 56 comprises a unitary structure including an upstanding and relatively small diameter supply mast 58 for connection to the flexible supply hose 37 (FIG. 1), and a relatively large diameter suction mast 60 through which particulate and debris are vacuumed into the filter bag 22 (FIG. 1). A combined swivel joint and inlet fitting 73 (FIGS. 2–5, 7–8 and 11) can be provided at the upper end of the supply mast 58 for quick and easy coupling to the flexible hose 37. If desired, this combined swivel joint and inlet fitting 73 may include a quick-release snap-lock mechanism suitable for rapid pushbutton disconnection or the like.

The supply mast 58 is formed to extend generally in parallel with and in a position behind the suction mast 60, with an array of contoured and integrally molded support ribs 62 (shown best in FIGS. 8, 11, 14 and 15) extending between the supply and suction masts 58, 60 to provide a strong unitized construction. A lower end of the supply mast 58 carries a laterally elongated flange 64 (shown best in FIG. 15) adapted for quick and easy mounting by screws 65 (FIG. 14) onto the upper side of the internal frame 23, in flow alignment with a hollow mounting collar 66 (FIGS. 14 and 18–19) formed in the internal frame 23. A lower end of the suction mast 60 extends downwardly into a matingly sized suction bore 68 (FIG. 14) formed in the internal frame 23, and may include outwardly radiating tabs 67 at opposite sides thereof for quick and easy mounting by screws 69 onto the upper side of the internal frame 23.

The upper ends of the supply mast 58 and the suction mast 60 of the cleaner mast unit 56 are both exposed through the upper housing shell 40, when said upper shell 40 is mounted onto the internal frame 23. That is, this upper housing shell 40 has a centrally located and generally keyhole shaped passage 70 (FIG. 7) formed therein to define a relative large diameter forward segment through which the upper end of the suction mast 60 extends, and a comparatively smaller diameter rearward segment through which the upper end of the supply mast 58 extends. The carrying handle 52 and associated ballast float 48 are located above and behind the upper end of the suction mast 58. Desirably, the upper housing shell 40 incorporates a contoured raised cowling segment 41 surrounding the keyhole passage 70, and sweeping upwardly rearwardly in cooperation with the struts 50 and the handle 52 to provide a sleek aerodynamic and race car look to the overall cleaner housing 14. The upper end of the suction mast 60 is shown to include a pair of latch ports 72 (FIGS. 14–15) formed in the laterally opposed sides thereof for quick and easy removable mounting of the filter bag 22 (FIG. 1), wherein the filter bag 22 may be constructed according to the filter bags shown and described in U.S. Pat. Nos. 4,589,986; 4,575,423; 4,618,420; and 5,863,425, which are incorporated by reference herein.

The mounting collar 66 formed in the internal frame 23 couples the water under pressure from the supply mast 58 to a water distribution manifold 74, which is also quickly and easily mounted onto the internal frame 23 as a modular component. This water distribution manifold 74 is shown best in FIGS. 11–17 and 19, and includes an inlet tube 76 having an upper end which fits upwardly through the mounting collar 66 into flow-coupled relation with the lower end of the supply mast 58. A seal ring 78 is desirably provided on the inlet tube upper end to prevent water leakage at this connection interface. The inlet tube 76 is formed at an upstream end of a manifold channel 80 which is cooperatively formed by interfitting upper and lower manifold sections 82 and 84 (FIGS. 15–16), and which further defines a plurality of outlets for directing the pressurized water to the hydraulic drive and vacuum systems of the pool cleaner. As shown best in FIGS. 10 and 15–16, the lower manifold section 84 includes appropriate laterally extending flanges 86 for quick and easy mounting of the assembled manifold 74 onto the underside of the internal frame 23 by means of screws 87 (FIG. 10) or the like.

Figure 11:
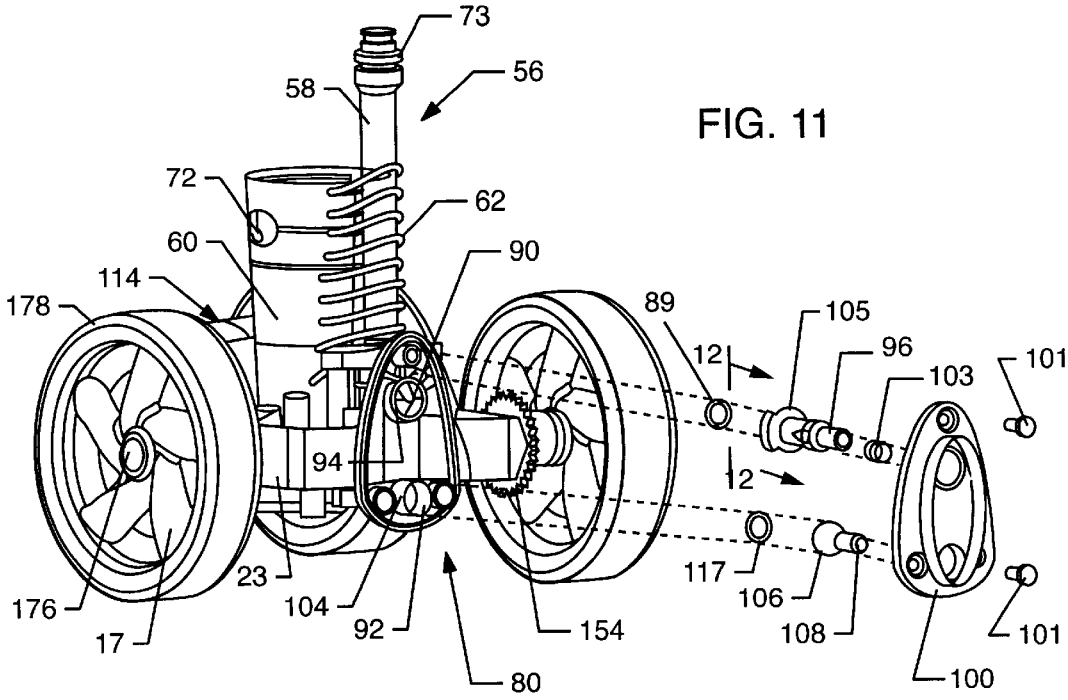
FIG. 11 is an enlarged rear perspective view showing the pool cleaner with the upper and lower housing shells removed, and further depicting a water distribution manifold in exploded relation with a rearwardly directed thrust jet and a sweep hose fitting.
Figure 12:
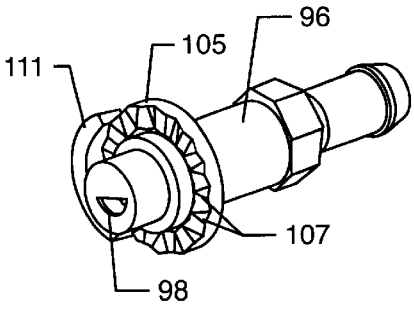
FIG. 12 is an enlarged perspective view showing one end of the sweep hose fitting, taken generally on the line 12—12 of FIG. 11.
Figure 13:
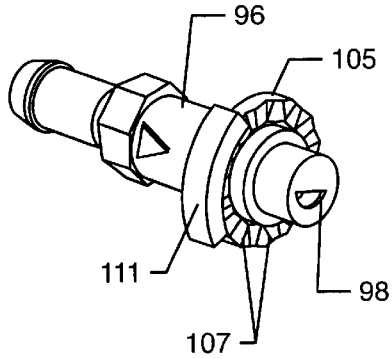
FIG. 13 is another enlarged perspective view showing one end of the sweep hose fitting of FIG. 12.
Figure 14:
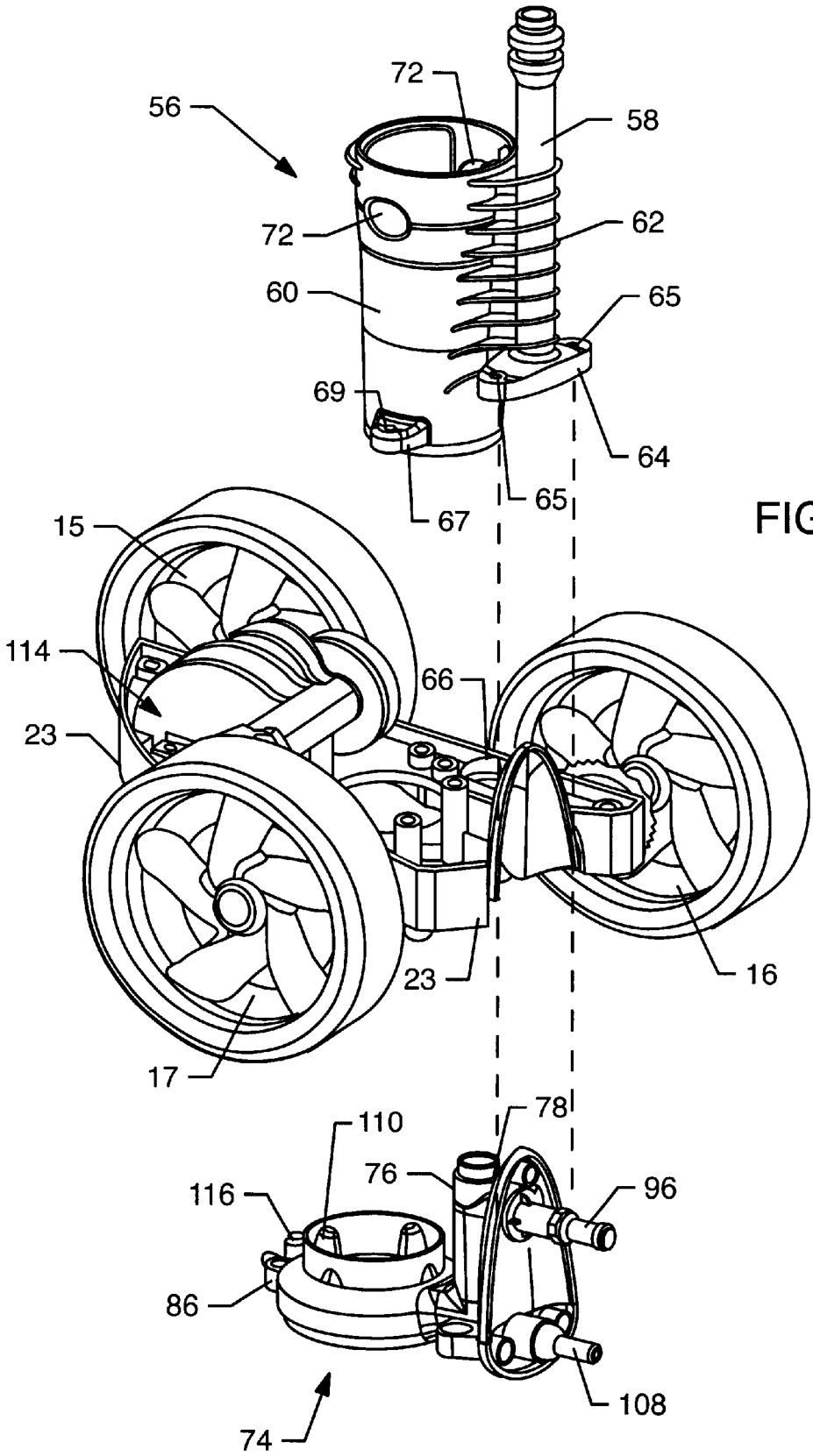
FIG. 14 is a rear perspective view illustrating the water distribution manifold and a cleaner mast unit in exploded relation with the internal frame of the pool cleaner.
Figure 15:
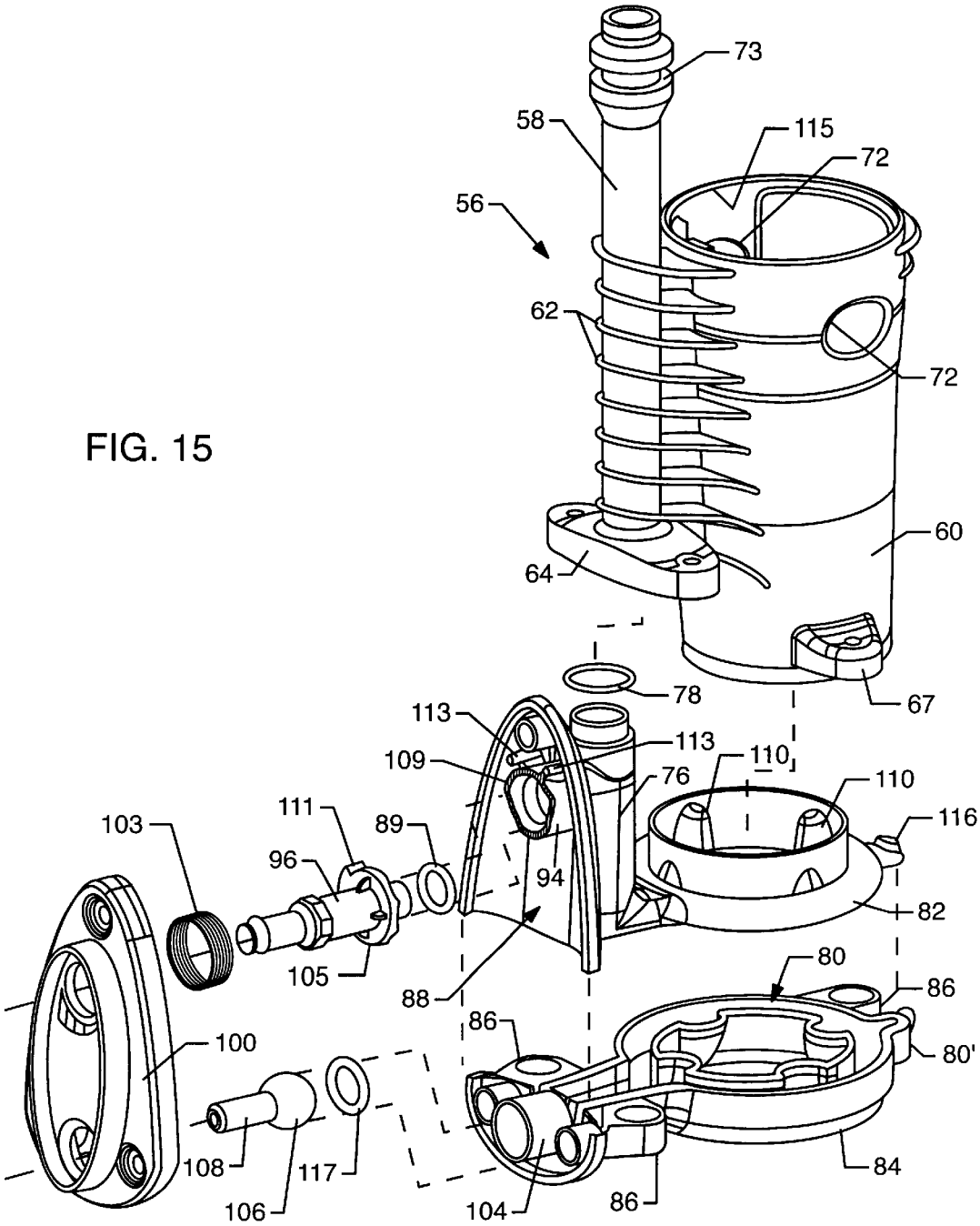
FIG. 15 is another perspective view showing the water distribution manifold and cleaner mast unit in exploded relation.
Figure 16:
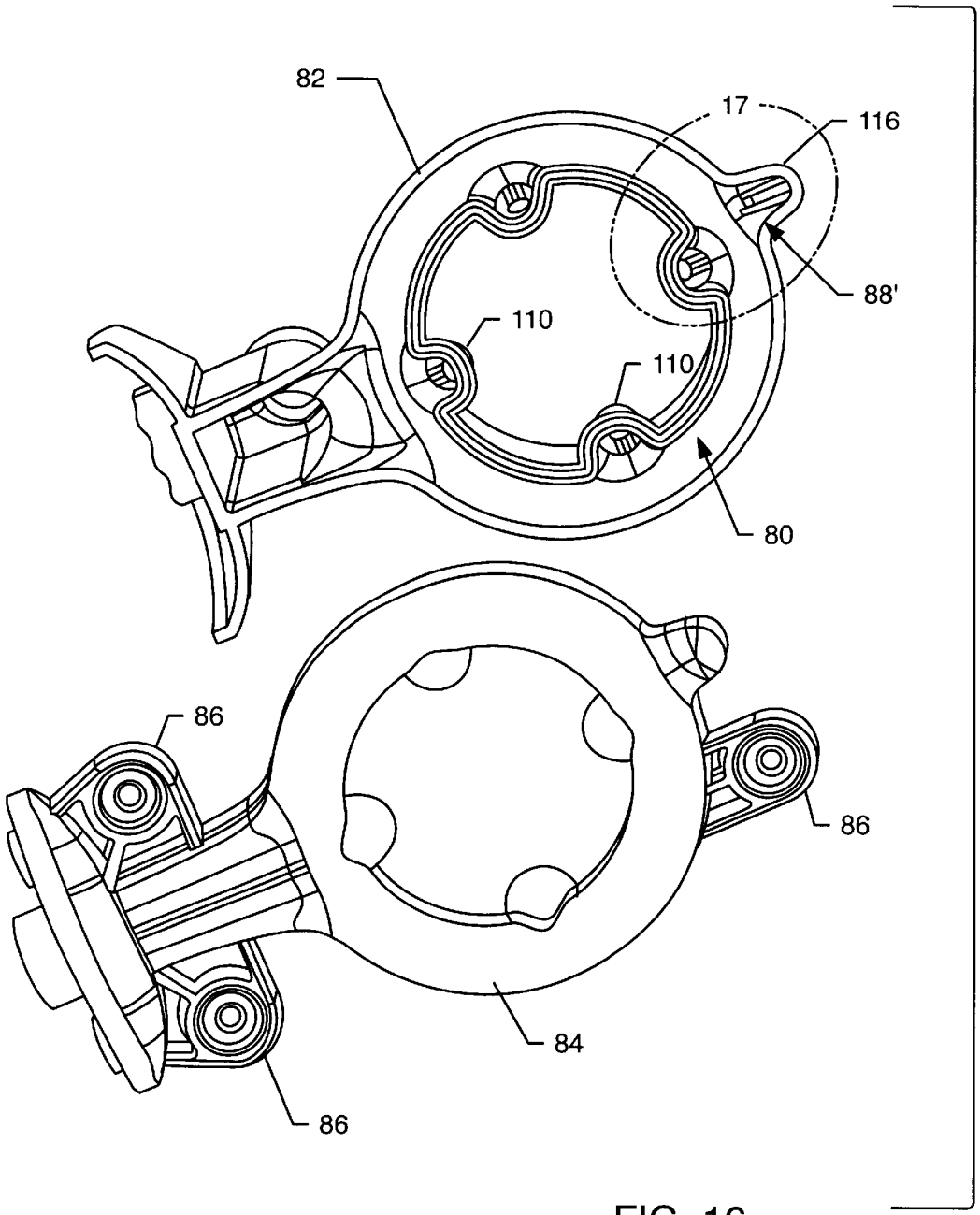
FIG. 16 is an enlarged fragmented exploded perspective view of a portion of the water distribution manifold to illustrate further construction details thereof.
Figure 17:
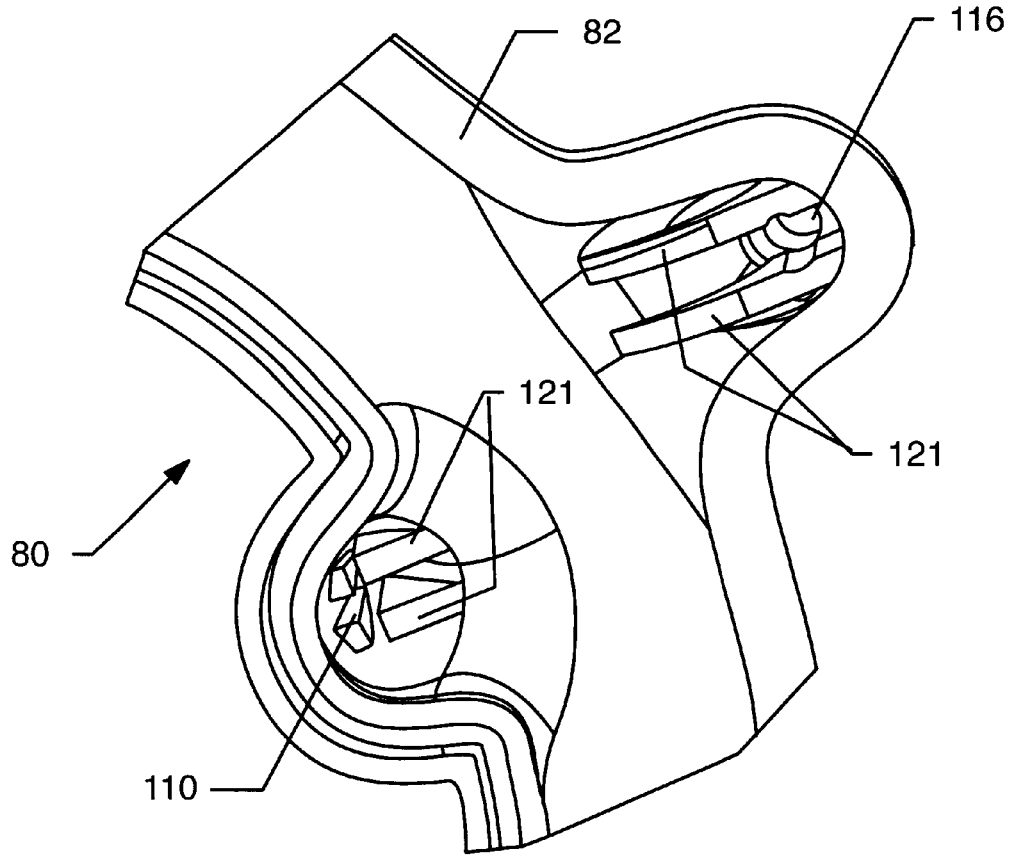
FIG. 17 is a further enlarged fragmented view of a portion of the water distribution manifold, corresponding generally with the encircled region 17 of FIG. 16.

More particularly, the interfitting manifold sections 82 and 84 cooperatively define a rearwardly open thrust chamber 88. As shown in FIG. 11, an upper narrow and generally half-circle shaped orifice 90 is formed in an upper region of this thrust chamber 88, and a comparatively larger outlet 92 is formed in a lower region of the thrust chamber. The upper orifice 90 is formed at an off-axis position within the base of a circular seat 94 having a size and shape for receiving the matingly shaped base end of a sweep hose fitting 96, with an O-ring seal 89 or the like (FIG. 15) interposed between the hose fitting 96 and the base of the circular seat 94. As viewed in FIGS. 12–13, the base end of the sweep hose fitting 96 also includes a narrow and generally half-circle shaped orifice 98 for alignment with the orifice 90, upon appropriate rotational orientation of the sweep hose fitting 96 relative to the circular seat 94. A thrust cap 100 is removably mounted onto the manifold unit 74 by screws 101 or the like for closing the thrust chamber 88, and for engaging and retaining the sweep hose fitting 96 with its base end positioned within the circular seat 94. An outer or tip end of the sweep hose fitting 96 normally carries an elongated and conventional sweep hose 102 (FIG. 1) which, in response to flow of pressurized water therethrough, whips back and forth to dislodge and suspend debris and particulate within the pool water 26.

In accordance with one aspect of the invention, the sweep hose fitting 96 can be rotatably adjusted relative to the circular seat 94 to obtain full or partial alignment of the orifices 90 and 98, and thereby regulate the water flow rate to the sweep hose 102. A spring 103 reacts between an inboard side of the thrust cap 100 and a flange 105 on the sweep hose fitting 96 for urging an annular array of stepped detents 107 on an inboard side of the flange 105 into axial bearing engagement with a mating array of stepped detents 109 on the circular seat 94. With this construction, manual rotational adjustment of the sweep hose fitting 96 relative to the manifold unit 74 is accompanied by a detectable clicking index action. An enlarged stop ear 111 may be provided on the fitting flange 105 for rotational movement between a pair of stop tabs 113 within the thrust chamber 88, to define opposite end limits of rotational adjustment of the sweep hose fitting 96. Disassembly of components, in whole or in part, is thus not required for adjusting the water flow rate through the sweep hose 102.

The larger lower outlet 92 opening into the thrust chamber 88 is associated with a second circular seat 104 adapted for receiving and supporting a bulb-shaped base end 106 of a rearwardly extending thrust jet 108. The bulb end 106 of the thrust jet is retained by the thrust cap 100 in firmly seated relation on the seat 104, with an O-ring seal 117 or the like (FIG. 15) interposed between the seat 104 and the bulb end 106. The thrust jet 108 projects rearwardly from the bulb end 106 through the thrust cap 100. The thrust jet 108 provides a rearwardly directed jet of pressurized water from the pool cleaner 10, to produce a corresponding forwardly directed reaction force which assists in overall cleaner operation. The bulb end 106 conveniently accommodates manual angular directional adjustment of this generally rearwardly directed thrust jet.

The inlet tube 76 of the manifold unit 74 additionally supplies the water under pressure to the manifold channel 80 formed by the upper and lower manifold sections 82 and 84 of the manifold unit. As viewed best in FIGS. 15–17, this manifold channel 80 extends forwardly from the rear thrust chamber 88, and then splits into a generally circular configuration having a size and shape to correspond generally with the diametric size and shape of the lower end of the suction mast 60. The manifold unit 74 is mounted by the screws 87 (FIG. 10) onto the underside of the internal frame 23 with this circular channel segment aligned generally coaxially with the bore 68 formed in the internal frame 23, and also generally coaxially with the bottom of the suction mast 60. The manifold sections 82, 84 cooperatively form a plurality of upwardly directed nozzle jets 110, four of which are shown at approximate 90° intervals lining the interior of the suction mast 60 at the lower end thereof, for jetting water upwardly within the suction mast toward the filter bag 22 mounted at the upper end thereof. These upwardly directed water jets induce an upward vacuum-type flow of water through the suction mast 60, for drawing accumulated particulate and debris upwardly through the hollow bore 115 of the suction mast 60 and into the filter bag mounted at the upper end thereof. In this regard, the lower housing shell 42 has a contoured suction inlet 112 opening formed therein (FIGS. 9 and 10) in alignment with the lower end of the suction mast 60, so that the pool floor or side wall surface immediately underlying the cleaner housing 14 within the triangular zone bounded by the cleaner wheels 15, 16 and 17 is effectively vacuumed.

Figure 18:
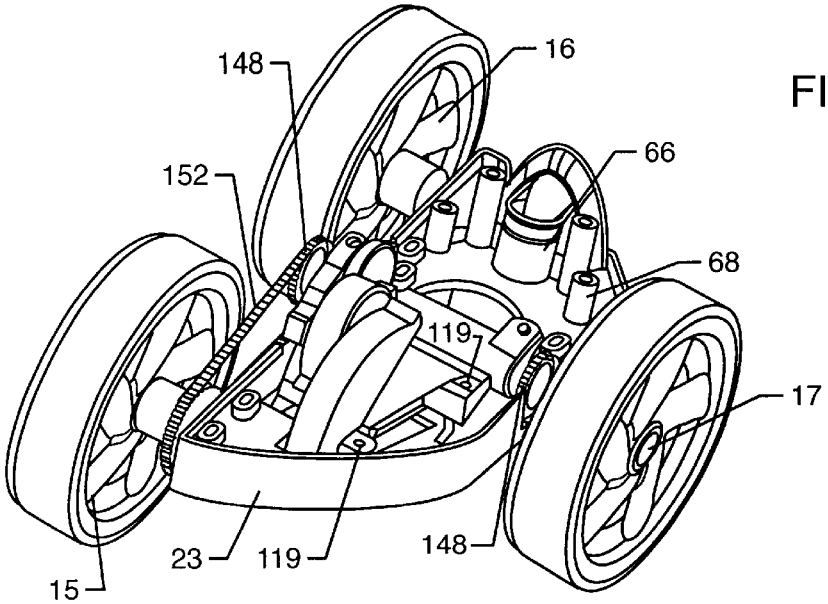
FIG. 18 is a front perspective view depicting the internal frame of the pool cleaner with the water distribution manifold and mast unit removed therefrom.

The manifold channel 80 includes a forward extension 80' (FIG. 16) protruding from the circular channel segment for delivering water under pressure to a water-powered drive unit 114. As viewed in FIGS. 15 and 16, this forward extension 80' of the manifold channel 80 terminates in an upwardly directed drive jet 116 which extends upwardly into and through a jet port 118 (FIG. 19) formed in the internal frame 23. This drive jet 116 couples the water under pressure to the drive unit 114 which is conveniently provided in module form for quick and easy mounting onto an upper side of the frame 23 by means of screws 119 or the like (FIG. 18).

In accordance with a further aspect of the invention, the manifold unit 74 includes means for reducing or eliminating clogging of the nozzle jets 110 or the drive jet 116 by particulate carried in the flow of water under pressure supplied to the pool cleaner. As shown best in FIGS. 16–17, this anti-clog means comprises a pair of spaced-apart ribs 121 formed in the upper manifold section 82 at the underside thereof, in general alignment with each of the upwardly directed jet nozzles formed therein. These pairs of ribs 121 are oriented generally in parallel with an inter-rib spacing having a width that is approximately equal to or slightly less than the diametric size of the associated jet nozzle. With this construction, any water-entrained particulate having a size sufficient to clog one of the jet nozzles will be prevented from passage to the jet nozzles by said pairs of ribs 121. In the event that such particulate becomes trapped by said ribs 121, the elongated spaced-apart rib construction provides a substantial remaining pathway for continued water flow to the associated jet nozzle. In practice, it is believed that such particulate tends to bounce off the ribs 121 and not become trapped thereby, for further particulate flow to and through the water powered drive unit 114. Persons skilled in the art will recognize and appreciate that alternative rib geometries, such as oblong or oval rib shapes, may be used.

The water-powered drive unit 114 is shown in detail in FIGS. 19–22. As shown, the drive unit 114 comprises a water-driven turbine 120 supported for rotation within a compact module housing including upper and lower housing members 122 and 124 retained in assembled relation by a plurality of screws or the like. The illustrative water-driven turbine 120 comprises a closed face turbine having a generally circular backplate 126 with a plurality of radially outwardly extending turbine vanes 128 formed on one side thereof. This turbine 120 is carried by a shaft 130 which is supported on the module housing by a pair of rotary bearings 132. Importantly, the turbine 120 is mounted within the module housing with the turbine vanes 128 positioned for rotary driving in response to water under pressure delivered by the drive jet 116 through a housing port 134 aligned with the jet port 116 in the internal frame 23. For optimum rotational speed and torque, to achieve optimally reliable driving of the pool cleaner, the turbine vanes 128 have a conventional Pelton wheel geometry extending radially outwardly from a cylindrical hub 129 and having a cup-shaped curvature defining recessed vane pockets for receiving the water under pressure jetted through the drive jet 116.

A driven gear 136 is formed on the turbine 120 at the side of the backplate 126 opposite the turbine vanes 128. This driven gear 136 is rotatably coupled to a speed reduction gear train shown to include a reduction gear 137 supported for rotation by bearings 135 and including a relatively large diameter gear segment 138 meshed with the driven gear 136, and a second smaller diameter gear segment 140 meshed with an output gear 142 mounted on a driven or output shaft 144 for rotation therewith. The output shaft 144 is carried by a pair of bearings 146 mounted on the drive unit housing, and has opposite ends extending outwardly from the drive unit housing with a pair of drive sprockets 148 mounted thereon. With this arrangement, the output shaft 144 and the drive sprockets 148 at the exterior of the drive unit housing are rotatably driven by the water-powered turbine 120, but at a reduced rotational speed. The internal drive components are thus protectively encased within the drive unit housing, with the pressurized water flow delivered thereto for driving the turbine 20 effectively preventing ingress of dirt and grit into contact with the moving drive components. However, the drive sprockets 148 are conveniently located outside the drive unit housing where they are accessible for quick and easy replacement without requiring disassembly of or access to the internally mounted turbine and gear components.

The drive sprockets 148 at the opposite sides of the turbine drive unit 114 are respectively coupled to a pair of sprocket or ladder-type chains 150 and 152 formed preferably from a metal such as stainless steel or the like for positively driving the cleaner wheels 15, 16 and 17. More particularly, as shown best in FIGS. 8 and 19, the sprocket chain 150 is wrapped over the drive sprocket 148 at one side of the drive unit 114, and further over a driven sprocket 154 mounted at the inboard side of the cleaner wheel 17 for rotation therewith. In a similar fashion, and as shown best in FIGS. 15 and 16, the second sprocket chain 152 has a longer length and is wrapped over the opposite drive sprocket 148, and further over a pair of similar driven sprockets 154 at the inboard sides of the two remaining cleaner wheels 15 and 16, respectively. To obtain position and common forward-direction driving of the two cleaner wheels 15 and 16, the sprocket chain 152 is additionally wrapped over an intermediate-mounted idler sprocket 157 (FIG. 19) rotatably supported at the side of the internal frame 23 by a suitable bearing (not shown).

With this construction as shown and described, the drive sprockets 148 engage and drive the two sprocket chains 150 and 152 at a common forward-drive rotational speed, for correspondingly driving the cleaner wheels to transport the pool cleaner 10 over submerged floor and side wall surfaces of the swimming pool 12. The sprocket chains 150, 152 provide a positive drive arrangement with essentially no slippage or uneven driven which can otherwise occur in response to drive wear or stretching of an elastomer-based drive belt.

Figure 23:
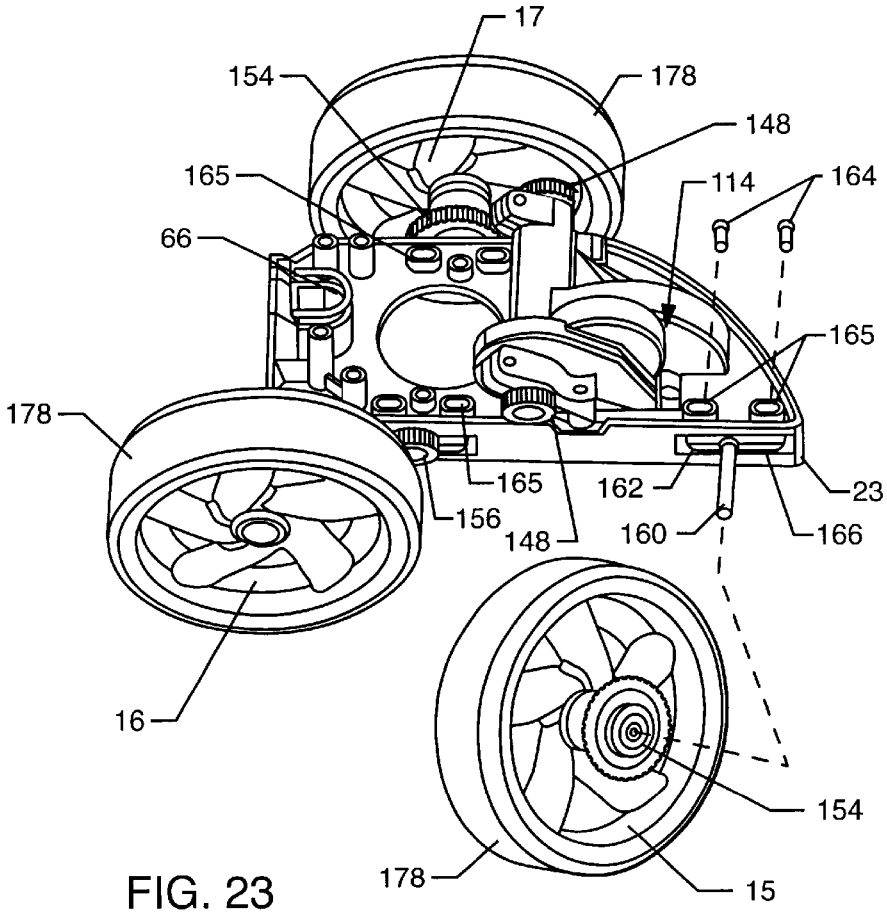
FIG. 23 is an exploded perspective view illustrating disassembly of one of a plurality of rotatable wheels from the internal frame of the pool cleaner.
Figure 19:
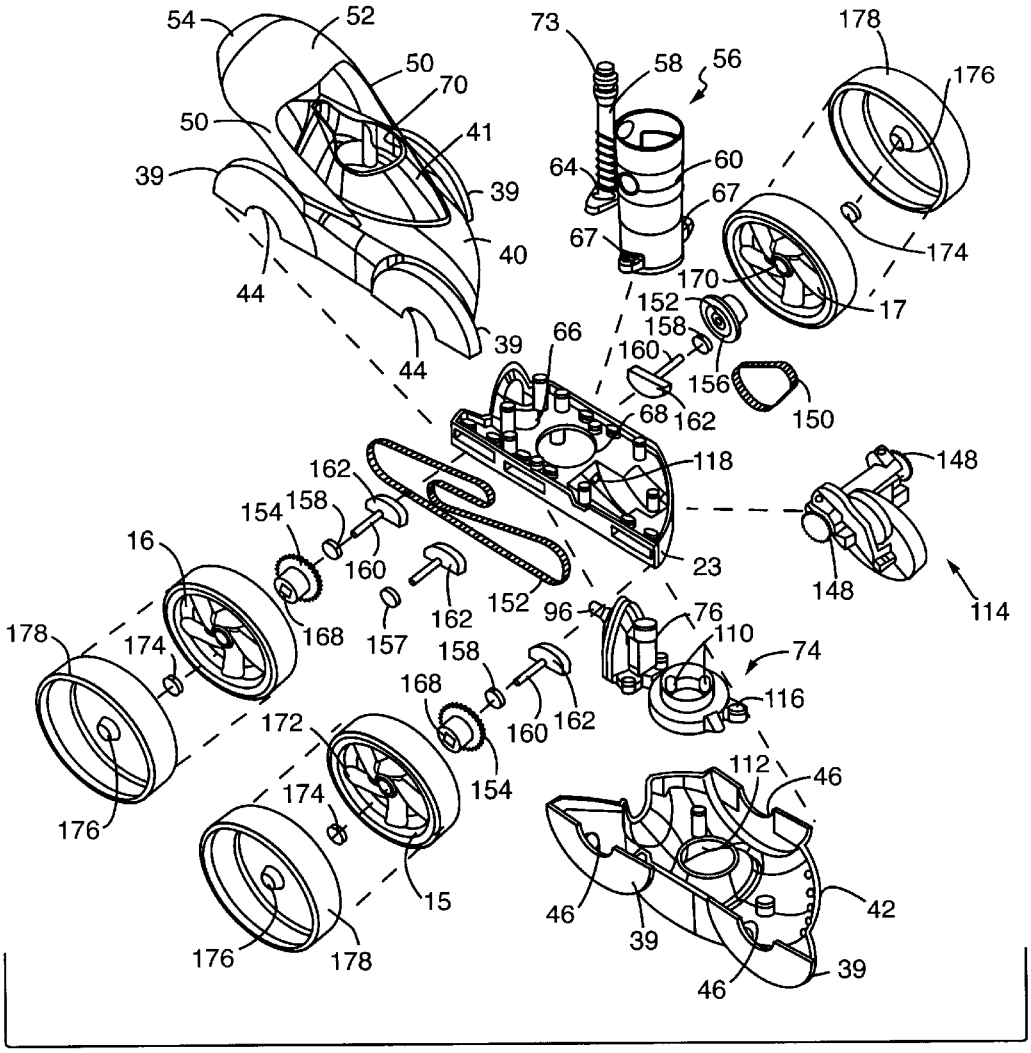
FIG. 19 is a further exploded perspective view of the pool cleaner.
Figure 20:
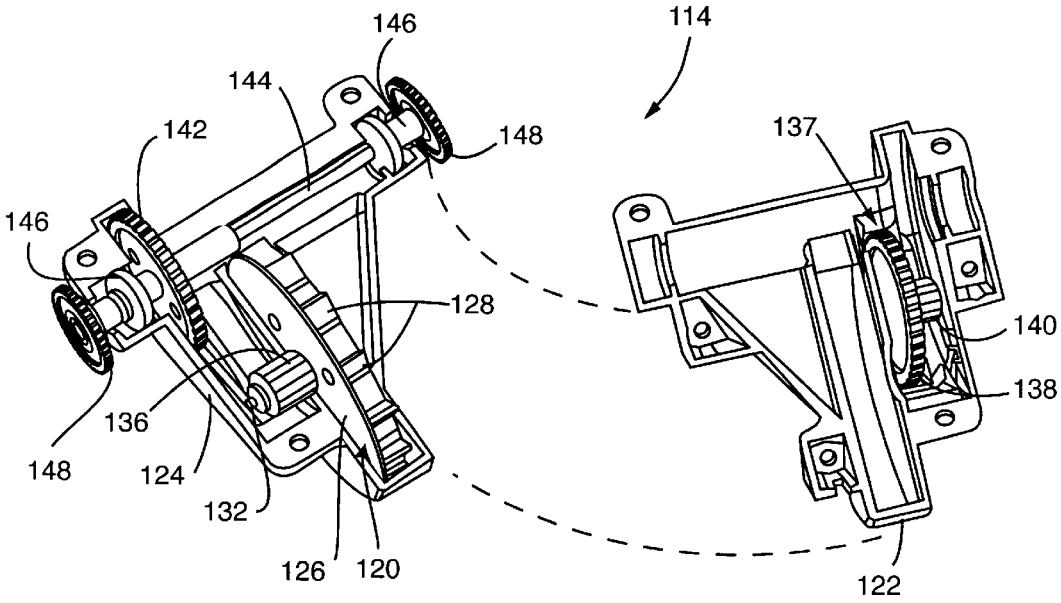
FIG. 20 is an exploded perspective view showing a water turbine drive unit for the pool cleaner.
Figure 21:
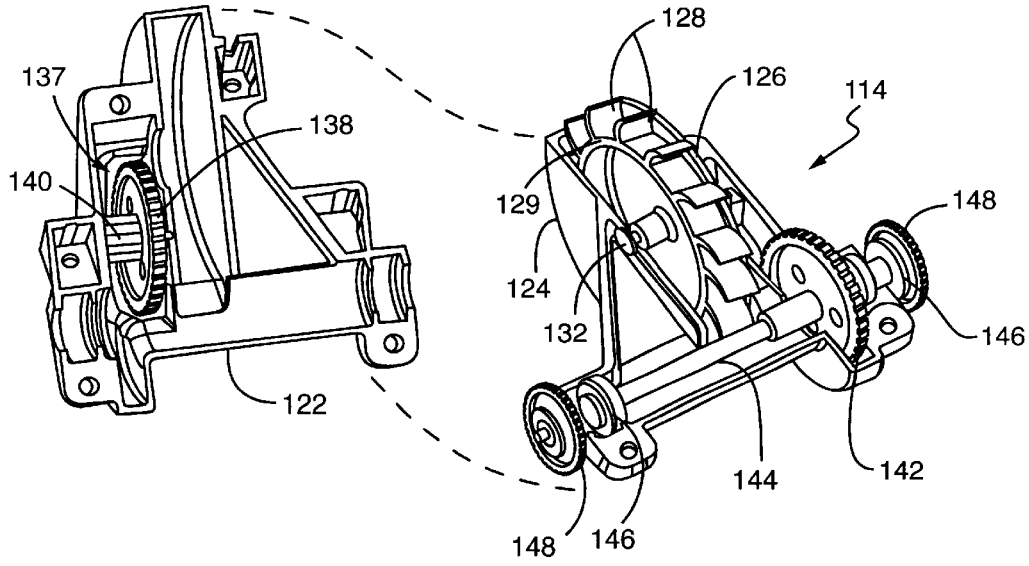
FIG. 21 is another exploded perspective view showing the water turbine drive unit.
Figure 22:
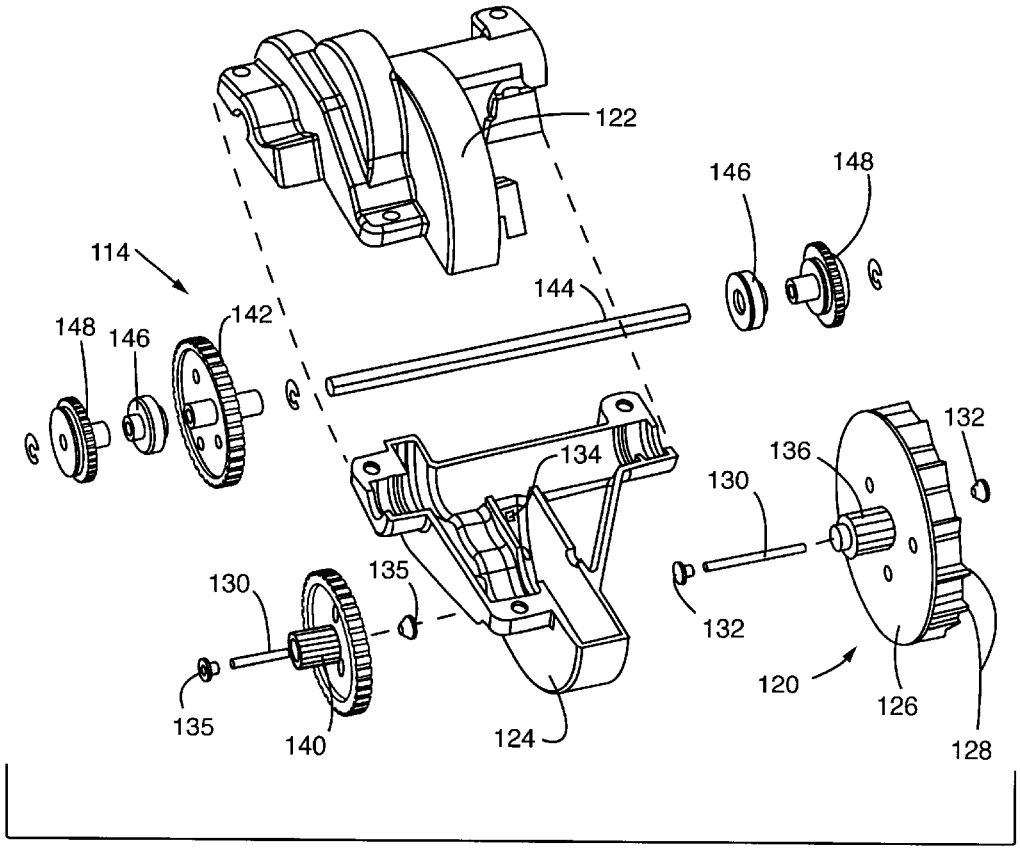
FIG. 22 is a further exploded perspective view of the water turbine drive unit.

The driven sprocket 154 at the inboard side of each cleaner wheel has an internal bore 156 for press-fit reception of a bushing 158 which is in turn carried on a short stub axle 160 (FIGS. 19 and 23). This stub axle 160 has an inboard end anchored on an elongated anchor or axle block 162 adapted for secure and stable seated mounting by means of screws 164 or the like within a laterally open pocket or slot 166 formed in the internal frame 23. An outboard segment of the sprocket bore 156 is internally splined, as indicated by reference numeral 168 in FIG. 19, for slide-fit and rotary drive engagement with an externally splined wheel hub 170 protruding axially inwardly from the associated cleaner wheel (FIG. 19). An outboard side of this splined hub 170 additionally includes an internal bore 172 for press-fit reception of an outer bushing 174 carried on an outboard end of the stub axle 160. A snap-fit cap 176 may be fitted onto the wheel hub 170 at the outboard side thereof to enclose and protect the outer bearing 174. Suitable resilient tires 178 may be removably carried by the wheels for improved traction engagement with submerged pool surfaces.

This splined drive connection between the driven sprockets 154 and the cleaner wheels 15, 16 and 17 beneficially provides a large drive engagement contact surface area, formed on the relatively large diameters of the internally splined sprocket bores 168 and the externally splined wheel hubs 170. This large drive engagement area permits the components to be constructed from economical plastic, while still providing reliable and long-lived service life. In addition, the elongated axle blocks 162 may advantageously have the respective metal stub axles 160 co-molded therein to provide a simple yet high strength construction. The axle blocks 162 have mounting holes preformed therein for accurate positioning within the respective frame pockets 166, and the frame 23 may include longitudinally elongated screw holes 165 (FIG. 23) to accommodate longitudinal position adjustment of one or more of the axle blocks 23 for appropriate tensioning of the drive chains 150, 152.

In operation, the pool cleaner 10 responds to the supply of water under pressure via the flexible hose 37 (FIG. 1) to the supply mast 58, to traverse submerged floor and side walls surfaces of the swimming pool for vacuuming debris and other particulate sediment upwardly through the suction mast 60 to the filter bag 22. The water distribution manifold 74 (FIGS. 11–17) delivers the pressurized water flow in the appropriate proportions to the sweep hose fitting 96 and the thrust jet 108, and also via the nozzle jets 110 for inducing the upward vacuum action through the suction mast 60. In addition, the water distribution manifold 74 couples the pressurized water flow via the forward drive jet 116 for powering the turbine drive unit 114, resulting in positive drive of the cleaner wheels 15, 16 and 17 by means of the sprocket chains 150 and 152.

In the event that service or repair of any pool cleaner component is necessary, one or both of the housing shells 40 and 42 can be quickly and easily removed from the internal frame 23. Such removal of the upper housing shells 40 exposes the mast unit 56 for quick and easy removal and replacement if needed. The water-powered drive unit 114 is also exposed for service and replacement of the drive sprockets 148 or the associated sprocket chains 150 or 152. Similarly, the entire drive unit 114 can be disassembled quickly and easily from the internal frame 23, if required, for repair or replacement. Removal of the lower housing shell 42 exposes the underside of the internal frame 23 for access to the water distribution manifold 74 for similarly quick and easy repair or replacement, as needed.

A variety of further modifications and improvements in and to the improved pool cleaner 10 of the present invention will be apparent to those persons skilled in the art. Accordingly, no limitation on the invention is intended by way of the foregoing description and accompanying drawings, except as set forth in the appended claims.

What is claimed is:

1. A pool cleaner for travel along submerged surfaces of a swimming pool to collect and dislodge debris, comprising:

an internal frame;

a hydraulically contoured cleaner housing including upper and lower housing shells mounted on said frame;

a plurality of wheels rotatably mounted on said frame and positioned outside said housing for supporting the cleaner on a pool surface;

a mast unit mounted on said frame and including a supply mast having an upper end positioned outside said housing for connection to a supply of water under pressure, and a suction mast having an open lower end exposed through said lower housing shell to an underside of said housing and an upper end positioned outside said housing for removable mounting of a debris collection bag;

a water distribution manifold carried by said frame and coupled to said supply mast for receiving and distributing water under pressure from said supply mast, said water distribution manifold including at least one upwardly directed jet nozzle for inducing an upward hydraulic vacuum flow through said suction mast for drawing water and entrained debris upwardly through said suction mast; and a water powered drive system carried by said frame and including a water driven turbine for rotatably driving at least one of said wheels, said water distribution manifold further including at least one drive jet for supplying a portion of the water under pressure for rotatably driving said turbine;

said housing substantially enclosing and encasing said frame and said water distribution manifold and said water powered drive system carried thereby, said upper and lower housing shells being separately removable from said frame for access to said frame and said water distribution manifold and said water powered drive system;

said upper housing shell further including at least one strut extending upwardly and rearwardly to an upper end positioned substantially above and behind a center of gravity for the pool cleaner, and further including a stabilizer float at said strut upper end.

2. The pool cleaner of claim 1 wherein said upper end of said supply mast is exposed through said upper housing shell.

3. The pool cleaner of claim 1 wherein said upper end of said suction mast is exposed through said upper housing shell.

4. The pool cleaner of claim 1 wherein said mast unit comprises a unitary module.

5. The pool cleaner of claim 1 wherein said supply mast and said suction mast are interconnected by a plurality of integrally molded support ribs.

6. The pool cleaner of claim 1 further including a carrying handle at said strut upper end.

7. The pool cleaner of claim 6 wherein said carrying handle has a pocket formed therein, said stabilizer float being mounted within said pocket.

8. The pool cleaner of claim 7 further including a float cap mounted onto said handle to enclose said stabilizer float within said pocket, and a nameplate carried by said float cap.

9. The pool cleaner of claim 1 wherein said at least one strut comprises a pair of struts extending generally in parallel from opposite sides of said upper housing shell generally upwardly and rearwardly to upper ends positioned substantially above and behind a center of gravity for the pool cleaner, said stabilizer float being carried at said strut upper ends.

10. The pool cleaner of claim 9 further including a carrying handle at said strut upper ends.

11. The pool cleaner of claim 10 wherein said carrying handle has a pocket formed therein, said stabilizer float being mounted within said pocket.

12. The pool cleaner of claim 11 wherein said pocket is rearwardly open, and further including a float cap mounted onto said handle to enclose said stabilizer float within said pocket, and a nameplate carried by said float cap.

13. The pool cleaner of claim 1 wherein said water distribution manifold comprises a module removably mounted on said frame.

14. The pool cleaner of claim 1 further including a sweep hose fitting mounted on said water distribution manifold and rearwardly exposed at the exterior of said housing for connection to a flexible sweep hose.

15. The pool cleaner of claim 1 further including a generally rearwardly directed thrust jet mounted on said water distribution manifold and rearwardly exposed at the exterior of said housing.

16. The pool cleaner of claim 1 wherein said at least one upwardly directly jet nozzle comprises a plurality of upwardly directed jet nozzles for inducing an upward hydraulic vacuum flow through said suction mast for drawing water and entrained debris upwardly through said suction mast.

17. The pool cleaner of claim 1 wherein said water powered drive system comprises a turbine module removably mounted on said frame and having said turbine rotatably supported therein, said turbine module defining an open port aligned generally with said at least one drive jet.

18. The pool cleaner of claim 17 wherein said turbine comprises a generally circular backplate having a plurality of radially outwardly extending turbine vanes formed thereon on one side thereof.

19. The pool cleaner of claim 18 further including a generally cylindrical hub carried on one side of said backplate, said turbine vanes extending generally radially outwardly from said hub and having a generally cup-shaped curvature defining recessed vane pockets for receiving water under pressure jetted through said at least one drive jet.

20. The pool cleaner of 17 further including a speed reduction gear train driven by said turbine for rotatably driving a driven shaft, at least one drive sprocket carried by said driven shaft, at least one of said wheels carrying a driven sprocket, and a sprocket chain reeved onto said drive and driven sprockets for rotatably driving said at least one of said wheels.

21. The pool cleaner of claim 20 further including an axle block removably mounted on said frame and including a laterally outwardly projecting stub axle, bushing means for rotatably supporting said driven sprocket and said at least one of said wheels on said stub axle, said driven sprocket and said at least one of said wheels including interengaging splines whereby said driven sprocket rotatably drives said at least one of said wheels.

22. The pool cleaner of claim 21 wherein said axle block is adjustably mounted on said frame for adjustably tensioning said sprocket chain.

23. The pool cleaner of claim 20 wherein said sprocket chain comprises a metal sprocket chain.

24. The pool cleaner of claim 17 further including a speed reduction gear train driven by said turbine for rotatably driving a driven shaft, first and second drive sprockets carried by said driven shaft generally at opposite ends thereof, first and second driven sprockets carried respectively by a pair of said wheels positioned respectively at opposite sides of said housing, and a pair of sprocket chains reeved respectively about first drive and driven sprockets and said second drive and driven sprockets for rotatably driving said pair of wheels.

25. The pool cleaner of claim 17 wherein said plurality of wheels comprises first and second wheels disposed in spaced front-to-rear orientation at one side of said housing and a third wheel disposed at an opposite side of said housing in a position with its rotational axis offset between the rotational axes of said first and second wheels; and further including a speed reduction gear train driven by said turbine for rotatably driving a driven shaft, first and second drive sprockets carried by said driven shaft generally at opposite ends thereof; first, second and third driven sprockets carried respectively by said first, second and third wheels; a first sprocket chain reeved about said first drive sprocket and said first and second driven sprockets for rotatably driving said first and second wheels; and a second sprocket chain reeved about said second drive sprocket and said third driven sprocket for rotatably driving said third wheel.

26. The pool cleaner of claim 25 further including a plurality of axle blocks removably mounted on said frame and each including a laterally outwardly projecting stub axle; and bushing means associated with each of said stub axles for rotatably supporting said first, second and third driven sprockets and said first, second and third wheels respectively on said stub axles; said first, second and third driven sprockets and said first, second and third wheels respectively including interengaging splines whereby said first, second and third driven sprockets respectively rotatably drive said first, second and third wheels.

27. The pool cleaner of claim 26 wherein each of said axle blocks is adjustably mounted on said frame for adjustably tensioning said sprocket chains.

28. The pool cleaner of claim 25 wherein said first and second sprocket chains comprise metal sprocket chains.

29. The pool cleaner of claim 25 further including an idler sprocket mounted on said frame at a position generally between said first and second wheels, said first sprocket chain being additionally reeved over said idler sprocket.

30. The pool cleaner of claim 1 wherein said upper and lower housing shells define wheel cowlings for protectively shielding inboard sides of said plurality of wheels.

31. A pool cleaner for travel along submerged surfaces of a swimming pool to collect and dislodge debris, comprising:

an internal frame;

a hydraulically contoured cleaner housing including upper and lower housing shells mounted on said frame;

a plurality of wheels rotatably mounted on said frame and positioned outside said housing for supporting the cleaner on a pool surface;

a mast unit mounted on said frame and including a supply mast having an upper end positioned outside said housing for connection to a supply of water under pressure, and a suction mast having an open lower end exposed through said lower housing shell to an underside of said housing and an upper end positioned outside said housing for removable mounting of a debris collection bag;

a water distribution manifold carried by said frame and coupled to said supply mast for receiving and distributing water under pressure from said supply mast, said water distribution manifold including at least one upwardly directed jet nozzle for inducing an upward hydraulic vacuum flow through said suction mast for drawing water and entrained debris upwardly through said suction mast;

a water powered drive system carried by said frame and including a water driven turbine for rotatably driving at least one of said wheels, said water distribution manifold further including at least one drive jet for supplying a portion of the water under pressure for rotatably driving said turbine;

a sweep hose fitting mounted on said water distribution manifold and rearwardly exposed at the exterior of said housing for connection to a flexible sweep hose; and said housing substantially enclosing and encasing said frame and said water distribution manifold and said water powered drive system carried thereby, said upper and lower housing shells being separately removable from said frame for access to said frame and said water distribution manifold and said water powered drive system;

said water distribution manifold including a seat with an off-axis orifice formed therein, said sweep hose fitting including a base end rotatably supported within said seat and having an off-axis orifice formed therein, said sweep hose fitting being rotatable relative to said seat for variably aligning said off-axis orifices to regulate water flow rate from said water distribution manifold through said sweep hose fitting.

32. The pool cleaner of claim 31 further including detent means cooperating between said sweep hose fitting and said water distribution manifold whereby rotation of said sweep hose fitting relative to said water distribution manifold is accompanied by a clicking action.

33. The pool cleaner of claim 32 further including stop means defining opposite end limits of rotational adjustment of said sweep hose fitting relative to said water distribution manifold.

34. A pool cleaner for travel along submerged surfaces of a swimming pool to collect and dislodge debris, comprising:

an internal frame;

a hydraulically contoured cleaner housing including upper and lower housing shells mounted on said frame;

a plurality of wheels rotatably mounted on said frame and positioned outside said housing for supporting the cleaner on a pool surface;

a mast unit mounted on said frame and including a supply mast having an upper end positioned outside said housing for connection to a supply of water under pressure, and a suction mast having an open lower end exposed through said lower housing shell to an underside of said housing and an upper end positioned outside said housing for removable mounting of a debris collection bag;

a water distribution manifold carried by said frame and coupled to said supply mast for receiving and distributing water under pressure from said supply mast, said water distribution manifold including at least one upwardly directed jet nozzle for inducing an upward hydraulic vacuum flow through said suction mast for drawing water and entrained debris upwardly through said suction mast; and a water powered drive system carried by said frame and including a water driven turbine for rotatably driving at least one of said wheels, said water distribution manifold further including at least one drive jet for supplying a portion of the water under pressure for rotatably driving said turbine;

said housing substantially enclosing and encasing said frame and said water distribution manifold and said water powered drive system carried thereby, said upper and lower housing shells being separately removable from said frame for access to said frame and said water distribution manifold and said water powered drive system;

said water distribution manifold further including a pair of spaced-apart ribs formed generally at an upstream end of said at least one upwardly directed jet nozzle, said spaced-apart ribs defining an inter-rib spacing that is equal to or less than the diametric size of said jet nozzle to prevent passage of water-entrained debris to said jet nozzle.

35. A pool cleaner for travel along submerged surfaces of a swimming pool to collect and dislodge debris, comprising:

an internal frame;

a hydraulically contoured cleaner housing including upper and lower housing shells mounted on said frame;

a plurality of wheels rotatably mounted on said frame and positioned outside said housing for supporting the cleaner on a pool surface;

a unitary mast unit module removably mounted on said frame and including a supply mast having an upper end positioned outside said housing for connection to a supply of water under pressure, and a suction mast having an open lower end exposed through said lower housing shell to an underside of said housing and an upper end positioned outside said housing for removable mounting of a debris collection bag;

a water distribution manifold module removably mounted on said frame and coupled to said supply mast for receiving and distributing water under pressure from said supply mast, said water distribution manifold module including at least one upwardly directed jet nozzle for inducing an upward hydraulic vacuum flow through said suction mast for drawing water and entrained debris upwardly through said suction mast; and a water powered drive system module removably mounted on said frame and including a water driven turbine for rotatably driving at least one of said wheels, said water distribution manifold module further including at least one drive jet for supplying a portion of the water under pressure for rotatably driving said turbine;

said housing substantially enclosing and encasing said frame and mast unit and water distribution manifold and water powered drive system modules carried thereby, said upper and lower housing shells being separately removable from said frame for access to said frame and said modules.

36. The pool cleaner of claim 35 wherein said upper end of said supply mast and said upper end of said suction mast are exposed through said upper housing shell.

37. The pool cleaner of claim 35 wherein said upper housing shell further includes at least one strut extending upwardly and rearwardly to an upper end positioned substantially above and behind a center of gravity for the pool cleaner, and further including a stabilizer float at said strut upper end.

38. The pool cleaner of claim 37 including a carrying handle at said strut upper end.

39. The pool cleaner of claim 38 wherein said carrying handle has a rearwardly open pocket formed therein, said stabilizer float being mounted within said pocket.

40. The pool cleaner of claim 39 further including a float cap mounted onto said handle to enclose said stabilizer float within said pocket, and a nameplate carried by said float cap.

41. The pool cleaner of claim 35 further including a sweep hose fitting mounted on said water distribution manifold module and rearwardly exposed at the exterior of said housing for connection to a flexible sweep hose.

42. The pool cleaner of claim 41 wherein said water distribution manifold module includes a seat with an off-axis orifice formed therein, said sweep hose fitting including a base end rotatably supported within said seat and having an off-axis orifice formed therein, said sweep hose fitting being rotatable relative to said seat for variably aligning said off-axis orifices to regulate water flow rate from said water distribution manifold module through said sweep hose fitting.

43. The pool cleaner of claim 42 further including detent means cooperating between said sweep hose fitting and said water distribution manifold module whereby rotation of said sweep hose fitting relative to said water distribution manifold module is accompanied by a clicking action.

44. The pool cleaner of claim 43 further including stop means defining opposite end limits of rotational adjustment of said sweep hose fitting relative to said water distribution manifold module.

45. The pool cleaner of claim 35 wherein said water distribution manifold module further includes a pair of spaced-apart ribs formed generally at an upstream end of said at least one upwardly directed jet nozzle, said spaced-apart ribs defining an inter-rib spacing that is equal to or less than the diametric size of said jet nozzle to prevent passage of water-entrained debris to said jet nozzle.

46. The pool cleaner of claim 35 wherein said water powered drive system module includes a turbine, said water powered drive system module further defining an open port aligned generally with said at least one drive jet for rotatably driving said turbine.

47. The pool cleaner of claim 46 wherein said turbine comprises a generally circular backplate having a plurality of radially outwardly extending turbine vanes formed thereon on one side thereof.

48. The pool cleaner of claim 47 further including a generally cylindrical hub carried on one side of said backplate, said turbine vanes extending generally radially outwardly from said hub and having a generally cup-shaped curvature defining recessed vane pockets for receiving water under pressure jetted through said at least one drive jet.

49. The pool cleaner of claim 46 wherein said plurality of wheels comprises first and second wheels disposed in spaced front-to-rear orientation at one side of said housing and a third wheel disposed at an opposite side of said housing in a position with its rotational axis offset between the rotational axes of said first and second wheels; and said water powered drive system module further including a speed reduction gear train driven by said turbine for rotatably driving a driven shaft, first and second drive sprockets carried by said driven shaft generally at opposite ends thereof; first, second and third driven sprockets carried respectively by said first, second and third wheels; a first sprocket chain reeved about said first drive sprocket and said first and second driven sprockets for rotatably driving said first and second wheels; and a second sprocket chain reeved about said second drive sprocket and said third driven sprocket for rotatably driving said third wheel.

50. The pool cleaner of claim 49 further including a plurality of axle blocks removably mounted on said frame and each including a laterally outwardly projecting stub axle; and bushing means associated with each of said stub axles for rotatably supporting said first, second and third driven sprockets and said first, second and third wheels respectively on said stub axles; said first, second and third driven sprockets and said first, second and third wheels respectively including interengaging splines whereby said first, second and third driven sprockets respectively rotatably drive said first, second and third wheels.

51. The pool cleaner of claim 50 wherein each of said axle blocks is adjustably mounted on said frame for adjustably tensioning said sprocket chains.

52. The pool cleaner of claim 49 wherein said first and second sprocket chains comprise metal sprocket chains.

53. The pool cleaner of claim 49 further including an idler sprocket mounted on said frame at a position generally between said first and second wheels, said first sprocket chain being additionally reeved over said idler sprocket.

54. The pool cleaner of claim 35 wherein said upper and lower housing shells define wheel cowlings for protectively shielding inboard sides of said plurality of wheels.

55. The pool cleaner of claim 35 wherein said supply mast and said suction mast of said unitary mast unit module are interconnected by a plurality of integrally molded support ribs.

56. In a pool cleaner for travel along submerged surfaces of a swimming pool to collect and dislodge debris, said pool cleaner including a housing supported for rolling movement on a plurality of wheels, the improvement comprising:

a nameplate on said housing, said nameplate bearing selected indicia and presenting the appearance of a vehicle license plate;

at least one strut extending upwardly and rearwardly from said housing to an upper end positioned substantially above and behind a center of gravity for the pool cleaner; and a stabilizer float at said strut upper end, said nameplate being disposed at a rear side of said stabilizer float.

57. The improvement of claim 56 wherein said nameplate is visible from a rear side of the pool cleaner.

58. The improvement of claim 56 wherein said selected indicia comprises alphabetic and numeric characters.

59. The improvement of claim 56 further including means forming a rearwardly open pocket disposed generally at said strut upper end, said stabilizer float being mounted within said pocket, and further including a float cap removably closing said pocket, said nameplate being disposed at a rear side of said float cap.

60. The improvement of claim 56 further including a carrying handle at said strut upper end, said pocket being formed in said carrying handle.

61. The improvement of claim 56 wherein said at least one strut comprises a pair of struts extending generally in parallel from opposite sides of said housing generally upwardly and rearwardly to upper ends positioned substantially above and behind a center of gravity for the pool cleaner, said stabilizer float being carried at said strut upper ends, said nameplate being disposed at a rear side of said stabilizer float.

62. The improvement of claim 61 further including means forming a rearwardly open pocket disposed generally at said strut upper ends, said stabilizer float being mounted within said pocket, and further including a float cap removably closing said pocket, said nameplate being disposed at a rear side of said float cap.

63. The improvement of claim 61 further including a carrying handle at said strut upper ends, said pocket being formed in said carrying handle.

64. In a pool cleaner for travel along submerged surfaces of a swimming pool to collect and dislodge debris, said pool cleaner including a housing supported for rolling movement on a plurality of wheels, the improvement comprising:

at least one strut extending upwardly and rearwardly from said housing to an upper end positioned substantially above and behind a center of gravity for the pool cleaner, and further including a carrying handle and a stabilizer float at said strut upper end.

65. The improvement of claim 64 wherein said carrying handle has a pocket formed therein, said stabilizer float being mounted within said pocket.

66. The improvement of claim 65 further including a float cap mounted onto said handle to enclose said stabilizer float within said pocket.

67. The improvement of claim 66 further including a rearwardly visible nameplate disposed on said float cap.

68. The improvement of claim 64 wherein said at least one strut comprises a pair of struts extending generally in parallel from opposite sides of said housing generally upwardly and rearwardly to upper ends positioned substantially above and behind a center of gravity for the pool cleaner, said carrying handle interconnecting said upper strut ends and supporting said stabilizer float.

69. The improvement of claim 68 wherein said carrying handle has a pocket formed therein, said stabilizer float being mounted within said pocket.

70. The improvement of claim 69 wherein said pocket is rearwardly open, and further including a float cap mounted onto said handle to enclose said stabilizer float within said pocket.

* * * * *